US006514047B2

(12) United States Patent
Burr et al.

(10) Patent No.: US 6,514,047 B2
(45) Date of Patent: Feb. 4, 2003

(54) LINEAR RESONANCE PUMP AND METHODS FOR COMPRESSING FLUID

(75) Inventors: Ronald Frederick Burr, Richmond, VA (US); Vernon Wade Popham, Richmond, VA (US); Christopher Charles Lawrenson, Glen Allen, VA (US); Franz Joseph Shelley, Mechanicsville, VA (US)

(73) Assignee: Macrosonix Corporation, Richmond, VA (US)

( * ) Notice: Subject to any disclaimer, the term of this patent is extended or adjusted under 35 U.S.C. 154(b) by 0 days.

(21) Appl. No.: 09/848,980

(22) Filed: May 4, 2001

(65) Prior Publication Data

US 2002/0164255 A1 Nov. 7, 2002

(51) Int. Cl.[7] ..... F04B 19/24; F04B 17/00; F04B 49/06

(52) U.S. Cl. ..... 417/53; 417/413.1; 417/415; 417/44.1; 417/45

(58) Field of Search ..... 417/413.1, 415, 417/44.1, 44.11, 45, 53

(56) References Cited

U.S. PATENT DOCUMENTS

| | | | | |
|---|---|---|---|---|
| 1,834,977 | A | 12/1931 | Schweisthal | |
| 2,253,206 | A | 8/1941 | Farrow | 103/53 |
| 2,721,453 | A | 10/1955 | Reutter | 62/115 |

(List continued on next page.)

FOREIGN PATENT DOCUMENTS

| | | | |
|---|---|---|---|
| JP | 56-77582 | A | 6/1981 |
| JP | 1-262359 | * | 10/1989 |
| JP | 11-6658 | * | 1/1999 |

OTHER PUBLICATIONS

Cadman, R.V., Cohen, R. Electrodynamic Oscillating Compressors: Part 1—Design Based on Linearixed Loads, Dec. 1969, Transaction of the ASME, pp. 656–663.

J. Polman, A.K. de Jonge and A. Castelijns, Free Piston Electrodynamic Gas Compressor, pp. 241–245. No date available.

Rick L. Bunch, Richard Stuber, New Concept for Improved Efficiency Compressors for Household Refrigerators and Freezers, pp. 260–262. No date available.

A.K. de Jonge, A. Sereny, Analysis and Optimization of a Linear Motor for the Compressor of a Cryogenic Refrigerator, pp. 631–640. No date available.

Gast Full Line Overview, Mar., 1998, pp. 1–13.

Reuven Z. Unger, Linear Compressors for Clean and Specialty Gases, pp. 51–56. No date available.

Eytan Pollak, F. J. Friedlaender, Werner Soedel, Raymond Cohen, Mathematical Model of an Electrodynamic Oscillating Refrigeration Compressor, pp. 246–259. No date available.

E. Pollak, W. Soedel, R. Cohen, F. J. Friedlaender, On the Resonance and Operational Behavior of an Ascillating Electrodynamic Compressor, Journal of Sound and Vibration, 1979, pp. 121–133. Only Year of Publication Available.

*Primary Examiner*—Charles G. Freay
*Assistant Examiner*—Michael K. Gray
(74) *Attorney, Agent, or Firm*—Michael N. Haynes

(57) ABSTRACT

A pump and methods for compressing a fluid are provided that comprise a pump head comprising a flexible metal diaphragm attached to a rigid compression chamber. Fluid compression is provided within the rigid compression chamber when the flexible diaphragm is mechanically oscillated back and forth by a linear motor operated at a drive frequency that is at or below the mechanical resonance of the moving parts, mechanical springs and gas springs. Tuned ports and valves allow low-pressure fluid to enter and high-pressure fluid to exit the compression chamber in response to the cyclic compressions. The linear resonance pump provides high frequency operation, small diaphragm displacements, and high compression ratios for gases.

59 Claims, 16 Drawing Sheets

U.S. PATENT DOCUMENTS

| | | | | | |
|---|---|---|---|---|---|
| 2,829,601 | A | | 4/1958 | Weinfurt | 103/53 |
| 2,872,877 | A | | 2/1959 | Brewer | 103/258 |
| 2,930,324 | A | | 3/1960 | Toulim | 103/53 |
| 3,361,067 | A | | 1/1968 | Webb | 103/1 |
| 3,529,980 | A | | 9/1970 | Bromer | 106/54 |
| 3,572,980 | A | | 3/1971 | Hollyday | 417/413 |
| 4,068,982 | A | * | 1/1978 | Quarve | 417/387 |
| 4,345,442 | A | | 8/1982 | Dorman | 62/160 |
| 4,450,685 | A | | 5/1984 | Corey | 60/520 |
| 4,538,964 | A | | 9/1985 | Brown | 417/267 |
| 4,599,052 | A | | 7/1986 | Langen | 417/413 |
| 4,726,227 | A | | 2/1988 | Moffatt | 73/505 |
| 4,772,828 | A | | 9/1988 | Heyman | 318/128 |
| 4,874,299 | A | * | 10/1989 | Lopez et al. | 310/24 |
| 4,953,366 | A | | 9/1990 | Swift | 62/467 |
| 5,020,977 | A | | 6/1991 | Lucas | 417/322 |
| 5,051,066 | A | | 9/1991 | Lucas | 417/207 |
| 5,167,124 | A | | 12/1992 | Lucas | 62/6 |
| 5,174,130 | A | | 12/1992 | Lucas | 62/498 |
| 5,263,341 | A | | 11/1993 | Lucas | 62/498 |
| 5,307,288 | A | * | 4/1994 | Haines | 415/144 |
| 5,319,938 | A | | 6/1994 | Lucas | 62/6 |
| 5,357,757 | A | | 10/1994 | Lucas | 62/6 |
| 5,429,484 | A | | 7/1995 | Honda | 417/398 |
| 5,515,684 | A | | 5/1996 | Lucas | 62/6 |
| 5,518,375 | A | * | 5/1996 | Vandromme et al. | 417/413.1 |
| 5,525,941 | A | | 6/1996 | Roshen | 333/112 |
| 5,537,820 | A | | 7/1996 | Beale | 60/517 |
| 5,579,399 | A | | 11/1996 | Lucas | 381/165 |
| 5,607,292 | A | | 3/1997 | Rao | 417/417 |
| 5,681,152 | A | * | 10/1997 | Ahs | 347/68 |
| 5,715,693 | A | | 2/1998 | Van der Walt | 62/198 |
| 5,867,991 | A | | 2/1999 | Jalink | 62/6 |
| 5,892,293 | A | | 4/1999 | Lucas | 290/1 R |
| 5,994,854 | A | | 11/1999 | Lawrenson | 318/114 |
| 6,054,775 | A | | 4/2000 | Vocaturo | 290/1 A |
| 6,079,214 | A | | 6/2000 | Bishop | 62/6 |
| 6,163,077 | A | | 12/2000 | Lucas | 290/1 R |

* cited by examiner

LINEAR RESONANCE PUMP AND METHODS FOR COMPRESSING FLUID

BACKGROUND OF THE INVENTION

1) Field of Invention

This invention relates generally to apparatus and methods for the pumping of gases and liquids and more specifically to the field of linear pumps and compressors.

2) Description of Related Art

Over the years, efforts have been undertaken for pump and compressor designs to yield desired ideal characteristics of operation such as operation free of oils of other external lubricants, commonly known as "oil-free operation", variable pumping capacity, few moving parts, compatibility with a wide range of toxic or chemically reactive gases, manufacturing simplicity, size, low cost, energy efficiency, and long life. The term "pump" is used herein consistent with its use by those skilled in the art to refer to both compressors and liquid pumps. The term "compressor" is typically used to designate machines that compress and discharge gases such as air or refrigerants. "Liquid pumps" are similar structures that typically compress the flow of a liquid. Pumps and compressors with such desired ideal characteristics have been sought for use in applications including the general compression of gases such as air, hydrocarbons, process gases, high-purity gases, hazardous and corrosive gases, as well as the compression of phase-change refrigerants for refrigeration, air conditioning and heat pumps, and other specialty vapor-compression heat transfer applications.

Prior pump design efforts have provided a diversity of pump designs that can be roughly defined in two classes of operation: positive displacement and kinetic compressors. Positive displacement compressors have been devised in two categories: (1) rotary compressors such as screws, scrolls, and rotary vanes; and (2) reciprocating compressors operating with crank-driven pistons, free-pistons, and diaphragms. Examples of kinetic compressors that have been provided are centrifugal and acoustic compressors. The operating principles of each of these compressors requires the designer to compromise or sacrifice many of the above-mentioned desired ideal characteristics in order to promote a specific characteristic in a particular design. Of particular present interest are efforts relating to free-piston compressors, diaphragm compressors and acoustic compressors.

Free-piston pumps and compressors have been designed with the hope of achieving conceptual simplicity by using a linear motor to move a reciprocating piston back and forth in its cylinder, thus eliminating crankshafts, connecting rods and bearings. However, in practice, the desired conceptual simplicity of such free-piston compressors has not been realized as other complex subsystems have been required for the operation of such free-piston compressors. For example, free-piston compressors have attempted to utilize variable capacity since the piston has no fixed displacement. With the intent of improving efficiency and capacity, such free-piston pumps have sought to operate at a resonance frequency that is defined by the piston mass and the spring stiffness of the gas-filled cylinder. However, such free-piston compressors, as with all piston compressors, require the piston to be moved very close to the head to minimize the clearance volume in the interest of volumetric efficiency. This requirement has resulted in such free-piston compressor designs experiencing undesired damage or diminished operation if the piston strikes the head during operation or during any transients that might occur. Thus, to attempt to achieve the desired characteristics in these free-piston compressor designs, elaborate and complicated controls have been required to keep the piston from striking the head during operation or during any transients that might occur. However, such controls have not satisfactorily performed under varying operational conditions.

Further, such free-piston compressors have sought to achieve oil-free operation by allowing the piston to float on a gas bearing. Unfortunately, the gas bearing has required very small clearances between the piston and cylinder, and thus high-precision machining has been required which is difficult and costly. The gas bearing also requires a network of small gas feed drillings that have a low tolerance for the moisture and particulate contamination often found in operation of such pumps and compressors. Under use conditions, such moisture and particulate contamination have caused obstructions in the small gas feed drillings that have resulted in failure or inferior performance of the gas bearings. Due to these complex subsystems that are required for operation and other reasons known in the art, these free-piston compressors have not realized certain of the desired ideal characteristics and have lacked the desired conceptual simplicity for a variety of commercial applications.

Further, attempts have been made to operate free-piston compressors at their resonance. The elements of the mass-spring resonance of certain of such free-piston compressors operated at their resonance are the compressed gas as the spring and the free piston as the mass. To take advantage of this mechanical resonance, free piston compressors must be able to accommodate the instabilities related to varying flow rates and varying compression ratios. Variations in both compression ratios and flow rates cause large variations in the spring constant of the gas. Also, low compression ratios provide little restoring force to the piston, thus causing the resonant frequency to drop below the operating frequencies needed for a given flow rate. Electromechanical and/or fluidic controls have been required in such free-piston compressors to compensate for these instabilities, thus adding complexity to the pump or compressor. Further, changing operating conditions have created an additional instability in these free-piston compressors. In operation, as the compression ratio changes, the average force exerted on the piston by the gas spring changes, thus causing the mean position of the oscillating piston to undesirably creep. This instability has also necessitated the use of various electromechanical and/or fluidic controls to stabilize the mean piston position.

In addition to free-piston compressors, diaphragm pumps and compressors have also been provided using a moving diaphragm to provide fluid compression. Attempts have been made to use such diaphragm compressors for oil-free operation by actuating such diaphragm pumps by a motor. Unfortunately, to provide the displacement needed for adequate flow rates, diaphragm compressors have typically required a non-metallic, elastic member, such as rubber, to be attached to the diaphragm. These flexible members of rubber, or other organic compounds, have been susceptible, in prior designs, to cracking, weakening, breakage or other failures of the elastic member under high pressure conditions that are necessary for the high compression ratios needed for many consumer, commercial, and industrial applications. Such susceptibility of the elastic rubber members to cracking, weakening, breakage or other failures under high pressures have reduced the reliability and life of these elastic rubber diaphragm members. Further, such elastic rubber members have not been compatible with certain fluids, such as fuels, oils, lubricants, coolants, solvents, and various chemicals, due to susceptibility of the diaphragm to cracking, weakening, degradation or failure when exposed to the fluid during operation. Certain rubber diaphragms have been used that were permeable to certain gases resulting in a flow of gas through the diaphragm and a pressure build up on the backside of the diaphragm. Also, such permeable rubber diaphragms have resulted in the contamination of the gas with rubber odors that are problematic in applications where individuals are exposed to the gas and may be allergic to the rubber odor absorbed by the gas. As such, these efforts to provide diaphragm compressors have also failed to provide the simplicity of a diaphragm design with desired characteristics in view of the required compromise in compression ratio, reliability, and application flexibility.

Certain pumps have also used valves and ports to produce flow in the pump in addition to the pressure lift to produce useful work. In typical compressors, large valves are used to provide checking action with minimized pressure loss. Such valves are typically large and relatively soft and have required mechanical stops to limit the valve's motion. One attempt to describe a pump using non-elastomeric, flat disk springs and with valves with valve stops is described in U.S. Pat. No. 3,572,980 to Hollyday. The '980 Patent describes a solenoid operated pump with a piston-cylinder arrangement wherein the piston is held by a flat disc spring functioning as a mechanical biasing for the piston and as a seal for the cylinder assembly. The Hollyday patent explains that a "resonant operating condition is accomplished by matching the spring rate of the disc to the mass of the moving parts such that the natural frequency of the spring-mass assembly equals the driving frequency or twice the driving frequency of the energy source."

The third type of pump or compressor, the acoustic compressor, has been provided to utilize resonant operation. In such resonant operation, generally, the excitation of an empty cavity's resonant acoustic mode creates pressure oscillations within the gas-filled cavity. These pressure oscillations have been typically converted into compression and flow by a set of reed valves that are attached to the cavity. The gas oscillates back and forth in the cavity alternately compressing and rarifying the gas. Much like a piston the displacement of this gas can be changed by varying the power input, thus resulting in variable pumping capacity. The use of resonance in resonance compressors results in high pressures and the absence of frictional moving parts to facilitate oil-free operation. However, these compressors that use acoustics as the means for providing resonance have provided disadvantages such as the large size of the cavity required to keep the operating frequencies within the range of practical compressor valves and the noise inherent in high intensity sound waves. As such, acoustic compressors tend to be physically large and noisy for a given pumping capacity, when compared to other types of compressors, which are both characteristics that can be negatives in certain commercial applications.

In summary, free-piston, diaphragm, and acoustic compressors have attempted to capture or utilize certain concepts that have the potential to provide certain of the ideal compressor characteristics described above such as variable capacity, oil-free operation, and simplicity of design. However, the current compressor designs that have sought to employ these concepts have produced many unwanted and commercially impractical disadvantages such as low compression ratios, reduced reliability, over-sized units, excessive noise, lack of fluid compatibility, need for complicated controls and high cost. Consequently, there exists a need for a pump and compressor technology that provides these ideal characteristics in an innovative manner without the historical disadvantages. As such, there also exists a need for a pump technology that can operate with the desired characteristics of oil-free operation, variable pumping capacity, few moving parts, compatibility with a wide range of toxic or chemically reactive gases, manufacturing simplicity, size, low cost, energy efficiency, and long life.

SUMMARY OF THE INVENTION

To overcome these needs and the limitations of previous efforts, the present invention is provided as a linear resonance pump for compressing fluids and includes a pump head comprising a rigid compression chamber including a wall having a geometry that defines a partial enclosure with an opening and a flexible diaphragm attached to an outer perimeter of the opening of the wall. The pump of the present invention uniquely integrates the concept of resonance with the structural simplicity of a diaphragm compressor to provide a new linear resonance pump having a wide range of improved characteristics. The pump provides fluid compression within the rigid compression chamber when the flexible diaphragm is mechanically oscillated back and forth by a motor. The pump includes tuned ports and valves that allow low-pressure fluid to enter and high-pressure fluid to exit the compression chamber in response to the cyclic compressions. The linear resonance pump also includes a motor that includes a moving portion operably connected with the diaphragm for oscillating the diaphragm at a drive frequency. The pump is desirably operated below a mechanical resonance whose frequency is determined by the moving mechanical mass of the diaphragm, a moving portion of the motor such as a piston operably connected with the diaphragm and the combined spring stiffness of the working fluid, the diaphragm, and other mechanical springs such as leaf springs connected with the moving portion.

The linear resonance pump of the present invention can be utilized in a variety of applications including the general compression of gases such as air, hydrocarbons, process gases, high-purity gases, hazardous and corrosive gases, with the compression of phase-change refrigerants for refrigeration, air conditioning and heat pumps with liquids, and other specialty vapor-compression heat transfer applications. The pump can also be utilized with liquids. The linear resonance pump can also provide variable capacity.

More specifically, one embodiment of the pump according to the present invention includes a pump head comprising a compression chamber having a wall geometry that defines a partial enclosure with an opening and a flexible diaphragm rigidly connected at an outer perimeter of the opening of the wall. The diaphragm includes a flexible portion that is free to move with respect to the outer perimeter between a plurality of first positions and a plurality of second positions, the first and second positions defining first and second volumes of the compression chamber. The pump head also includes a tuned suction port and a tuned discharge port connected in communication with the compression chamber for flowing fluid into the compression chamber through the suction port and for flowing fluid out of the compression chamber through the discharge port.

The pump also includes a fluid spring comprising the fluid that is introduced into the compression chamber being subject to varying pressure and flow conditions and a mechanical spring that comprises the diaphragm and, optionally leaf springs connected with the moving portion. In this embodiment the motor is in the form of a stator and an armature with the armature cyclable between the first positions and the second positions at a drive frequency. As the armature and diaphragm cycle into the first position the flexible portion of the diaphragm flexes to generally conform in shape to the curved section of the wall of the compression chamber for minimizing clearance volume in the compression chamber. The motor of this embodiment is a variable reluctance motor, but in other embodiments alternative motors could be used, such as motors having a piezoelectric element or a voice coil linear motor.

In operation of the pump, a mass-spring mechanical resonance frequency is determined by the combined moving masses of the moving portion and the diaphragm and by the mechanical spring and the gas spring. In the preferred embodiment, the motor is operable at a drive frequency that is less than the mechanical resonance frequency. In alternative embodiments, the motor's drive frequency can be equal to the mechanical resonance frequency.

To facilitate the resonance operation, the pump head is desirably provided with the tuned suction port and discharge port mentioned above. The ports each have a geometry comprising a diameter, length and cross-sectional shape and the ports are each tuned by selecting the geometry of the port to achieve optimal flow resistance and timing characteristics so as to coordinate the filling and discharge of the fluid flow through the suction port and discharge port respectively in coordination with the pressure cycle in the compression chamber to provide a net flow in one direction of the fluid within the pump.

Resonant operation can be further facilitated by a valve that operatively connected to each port. For example, in this first embodiment, a discharge valve is operatively connected to the discharge port and a suction valve is operatively connected to the suction port. Each valve has a predetermined stiffness and a valve duty cycle wherein the valve prevents flow through the port in a closed position and allows flow through the port in an open position. The valves are tuned by selecting the valve stiffness and geometry, including size, such that the timing of the duty cycle of the valve is coordinated with the timing of the filling and discharge of the fluid flow through the ports and the pressure cycle in the compression chamber to provide a net flow in one direction of the fluid within the pump. The valves are adapted to each be maintained in the open position by fluid pressure differential across the valve during flow and without needing any mechanical stops. The valves operate through each of a plurality of duty cycles in a continuous motion. Tuning the valves and ports facilitates the operation of the pump at high frequencies of 100 cycles per second or greater to produce desired fluid compression. The ports can be provided as a single port, or alternatively, as a plurality of ports. The valves can be provided as a single valve for embodiments with a single port, or alternatively, with a plurality of valves corresponding to a plurality of ports. Properly tuned ports can facilitate compression and flow of the pump without valves. The addition of valves provides further enhancement of the pump's performance.

To still further facilitate the operation of the pump at resonance and at high frequencies with high compression ratios, the pump can be provided with a hole from the compression chamber to the exterior of the compression chamber, or alternatively a plurality of holes. The hole is provided in the diaphragm, or alternatively in other parts of the pump head or pump. This hole or holes are tuned by selecting the geometry of the hole, including the size in diameter and length, to communicate a sufficient quantity of fluid through the hole for equalizing pressure on a first and second face of the diaphragm. Maintaining the equilibrium of pressure on the first and second faces of the diaphragm prevents undue stress on the diaphragm and further prevents undesirable creeping of the diaphragm's equilibrium position, which can lead to reduced motor performance.

In a still further aspect of the pump the pump can include a single or, alternatively a plurality of leaf springs connected with the moving portion of the motor as one of the mechanical springs for providing restoring force and displacement of the moving portion such as the armature during cycling of the moving portion armature to reduce pressure on the diaphragm.

In this first embodiment of the pump, the diaphragm is made from a metal material of steel. A metal backpressure chamber can be provided in communication with the second face of the diaphragm and outside the compression chamber to provide an all-metal wetted flow path for flow of certain fluids. The use of the diaphragm allows for operation of the pump free of external lubricants. This oil free operation also allows for use of the pump irrespective of gravitational orientation for uses such as in boats or jets.

In another aspect of the present invention, the pump may also be provided with control means that are operatively connected with the linear motor for varying the drive frequency of the linear motor to oscillate the diaphragm below the mechanical resonance frequency. In alternative embodiments the control means can be used to operate the pump on the mechanical resonance frequency. The control means can be provided in alternative embodiments as a closed loop controller or an open loop controller as described below.

In still another aspect of the invention, the pump can be provided as a high frequency pump for compressing gases with tuned ports and valves as described above and which can operate at or below the mechanical resonance frequency.

In another aspect of the invention, a method for compressing a fluid using the pump is provided as follows. A similar pump as that described in the first embodiment is provided. Having provided this pump, a fluid is introduced into the compression chamber at a first pressure. This fluid acts as a fluid spring under varying pressure conditions. The mass-spring mechanical resonance frequency is determined by the combined moving masses of the moving portion of the motor and the diaphragm and by the mechanical spring including the diaphragm and leaf spring and the gas spring. The motor is operated at a drive frequency that is near and less than the corresponding mechanical resonance to cycle the moving portion and diaphragm between the first and second positions. The fluid is compressed to a desired pressure and evacuated from the compression chamber at a second pressure.

The method can further include providing the diaphragm with the hole as described, the hole being sized in diameter and length to communicate a sufficient quantity of fluid through the hole for equalizing pressure on the first and second faces; and further comprising after the oscillating step, equalizing pressure on the first and second faces of the diaphragm during said oscillation by flowing fluid through the hole. Still alternatively, the method of compressing a fluid can further comprise the step of tuning a ports such as a suction port and discharge port by selecting the sizing of each port's geometry including the diameter, length and cross-sectional shape to coordinate the timing of the filling and discharge of the fluid flow through the ports and the pressure cycle in the compression chamber to provide a net flow in one direction of the fluid through the port. Likewise the method can include providing a tuned valve for each of the ports. Each of the valves is operatively connected to a port and has a predetermined stiffness and a valve duty cycle. The valve prevents flow through the port in a closed position and allows flow through the port in an open position. Tuning the valve comprising selecting the valve stiffness and geometry to provide a duty cycle with a timing that is coordinated with the timing of the filling and discharge of the fluid flow through the ports and the pressure cycle in the compression chamber to provide a net flow in one direction of the fluid within the pump.

The method of compressing a fluid can include in the compressing step compressing the fluid in a series of cycles at a high frequency of 100 cycles per second or greater. Further, the method can further comprise in the operating step, varying the drive frequency of the linear motor in accordance with the mechanical resonance frequency. Still further, the operating step can include varying the drive frequency by a closed loop controller or open loop controllers as described below. In these and other embodiments, the resonant operation of the linear resonance pump of the present invention provides advantages including high frequency operation, small diaphragm displacements, high compression ratios for gases, and small size. The linear resonance pump further enables the provision of a simple gas compressor with an all metal diaphragm that provides high compression ratios and also includes an all metal wetted flow path that promotes compatibility with a wide range of toxic, high-purity, reactive, or environmentally hazardous fluids. It is a still further benefit of the present invention that the linear resonance pump eliminates any frictional moving parts, thus providing oil-free operation and the freedom to operate the compressor in any physical or gravitational orientation. The linear resonance pump according to the present invention also provides high frequency resonant operation in a relatively small sized unit, and in certain embodiments can provide a resonant positive-displacement compressor with high stability under low pressure high-flow conditions. A still further benefit is that the linear resonance pump can provide a compressor with a soft start characteristic that prevents electrical current spikes upon start up.

These and other objects and advantages of the invention will become apparent from the accompanying drawings, wherein like reference numerals refer to like parts throughout.

BRIEF DESCRIPTION OF THE DRAWINGS

The accompanying drawings, which are incorporated in and form a part of the specification, illustrate the embodiments of the present invention and, together with the description, serve to explain the principles of the inventions. In the drawings.

DETAILED DESCRIPTION OF THE PREFERRED EMBODIMENTS

Air and Gas Compressor

Figure 1:
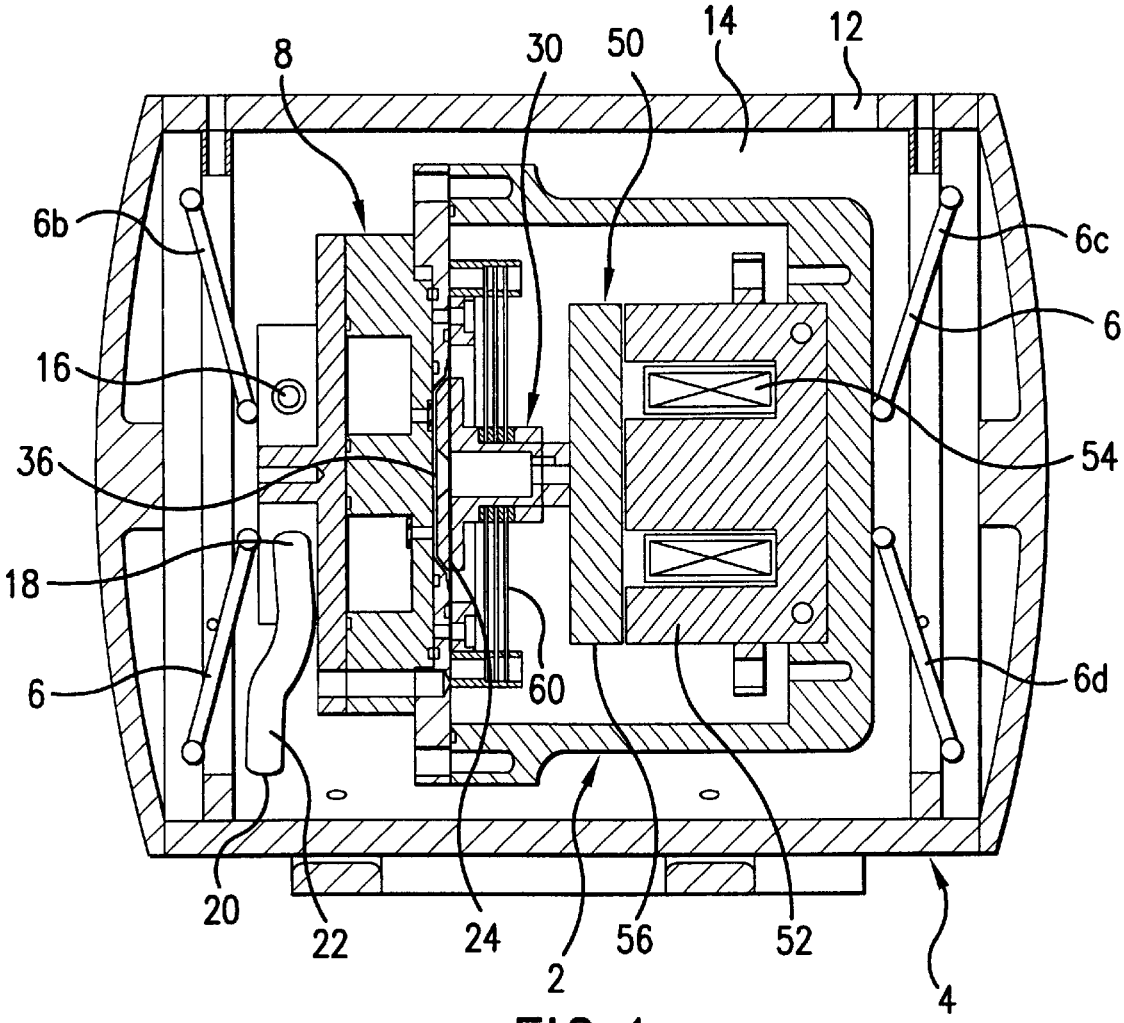
FIG. 1 is a cross sectional view of a first embodiment of an air or gas compressor in accordance with the present invention.

Referring now to FIG. 1 there is illustrated a cross-sectional view of an embodiment of the linear resonant pump of the present invention in the form of an air or gas compressor. This embodiment comprises a pump in the form of an air compressor 2 suspended in an exterior shell 4 by a suspension 6. The suspension 6 is comprised of suspension elements 6*a*, 6*b*, 6*c*, 6*d* connected in tension with the shell 4 on opposite sides of the compressor 2. The tension in suspension elements 6 positions the compressor 2 both radially and axially within the shell 4 and prevents contact between the compressor 2 and the inner surfaces of the shell 4 during operation. Compliance in the suspension elements 6 reduces the transmission of vibration and sound from the compressor 2 to the shell 4 and its surroundings. The suspension elements are depicted in the embodiment of FIG. 1 as elastomeric bands 6*a*, 6*b*, 6*c*, 6*d* but they may be provided in alternative embodiments as metal coil extension springs or other suspension elements with like properties.

The compressor 2 comprises two main sub-assemblies, the pump head 8 and the motor 50. The compressor 2 is provided with fluid interconnection between the compressor 2 and the external environment is made in a manner so as to minimize vibration and noise transmission. A fluid, in this embodiment of FIG. 1 an air or gas, enters the shell 4 through the inlet port 12 and fills the cavity 14 that exists between the compressor 2 and the shell 4. Cavity 14 acts as a plenum that provides noise muffling and smoothing of pressure pulsations. Alternative embodiments of the pump can be provided without a shell 4. Various materials can be used to construct the pump in order to provide chemical compatibility with a given fluid. The pump in various embodiments can be utilized to compress gases such as air, hydrocarbons, process gases such as nitrogen, hydrogen, oxygen; hazardous and corrosive gases.

The fluid is drawn into the compressor 2 through the compressor inlet port 16. Gas is discharged from the compressor 2 through the compressor discharge port 18 and directed to the enclosure outlet 20 through a flexible tubing interconnect 22. The flexible tubing interconnect 22 is provided as an elastomeric material and can be provided in alternative embodiments as a metal or other material.

Figure 2:
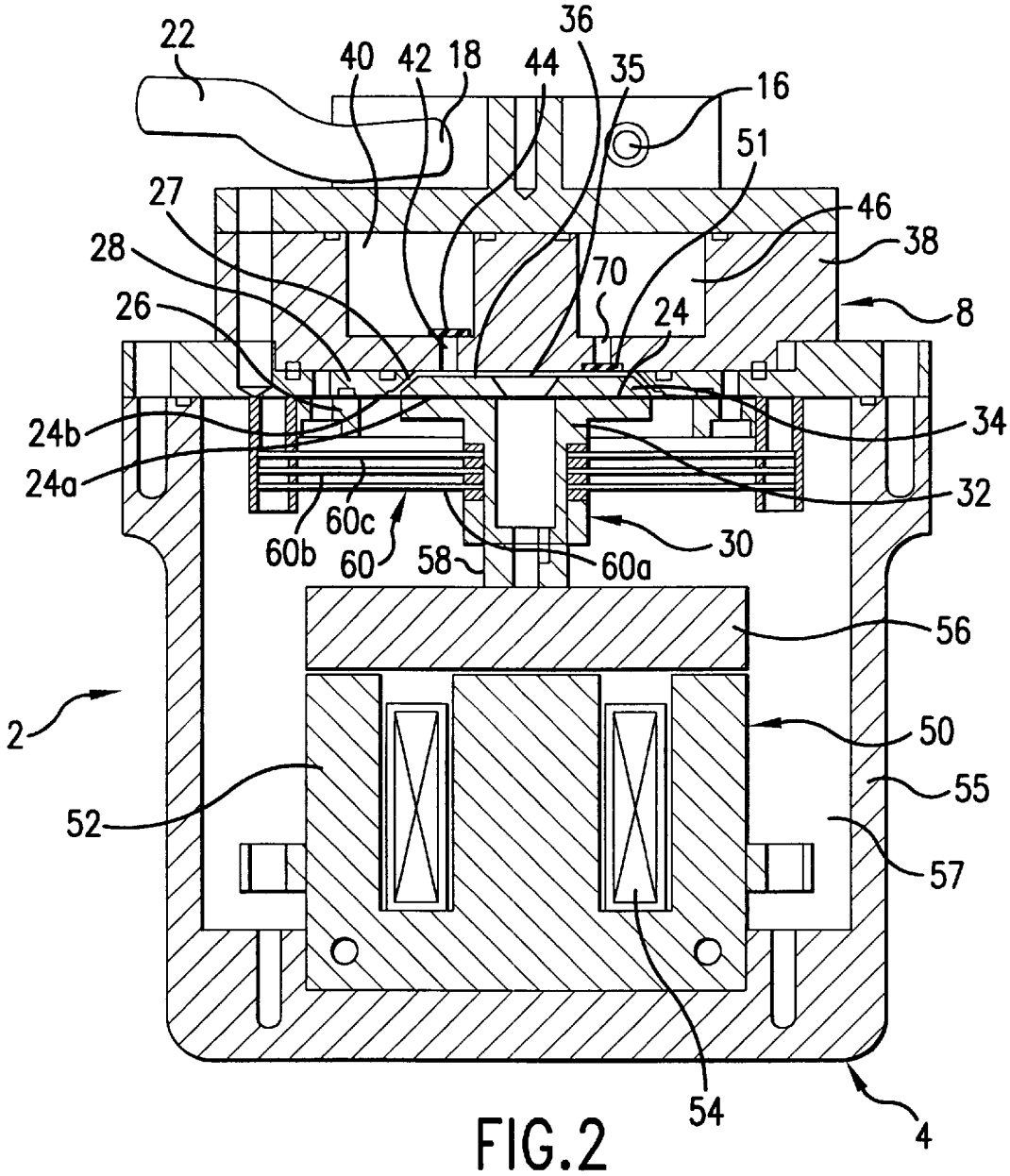
FIG. 2 is an enlarged view of the gas compressor of FIG. 1.

FIG. 2 provides an enlarged view of the compressor 2 of FIG. 1. The pump head assembly 8 includes a diaphragm 24, which is clamped around its perimeter between an annular clamping ring 26 and a compression chamber plate 28. The pump head assembly 8 also comprises a valve head 38 having a piston 30 including a piston base 32 and a piston cap 34. The piston acts, in this embodiment as the moving portion. Diaphragm 24 is further clamped between the piston base 32 and the piston cap 34 of piston 30. During operation, piston base 32 and piston cap 34 move together as a single member. The portion 24*b* of diaphragm 24 between piston base 32 and piston cap 34 cannot bend or flex and remains planner during such movement. The portion 24*a* of diaphragm 24 between the inner diameter of clamp 26 and the outer diameter of piston cap 34 is free to flex and bend as piston 30 moves cyclically back and forth along its axis from a first position at the end or top of the compression stroke and to a second position at the end of the suction stroke. The flexible diaphragm 24 is formed of steel.

Still referring to FIG. 2, the pump 2 further comprises a compression chamber 36 that is formed by components including piston cap 34, diaphragm 24, compression chamber plate 28, and a valve head 38. The compression chamber 36 can be described with the valve head 38 defining a part of a wall portion 35 of the compression chamber 36 and the piston cap 34, compression chamber plate 28 and diaphragm 24 defining a part of a bottom portion of the compression chamber 36.

The piston 30 and diaphragm 24 are free to move between a plurality of first positions and a plurality of second positions. The piston 30 and the diaphragm 24 in the first positions are proximal to the wall portion 35 of the compression chamber 36 at the top of a respective compression stroke, and the second positions are distal to the wall portion 35 of the compression chamber 36 at the end of a respective suction stroke. The diaphragm 24 is operably movable to a plurality of the first positions on successive compression strokes and a plurality of second positions on successive suction strokes in response to varying drive force from the linear motor. The first positions can be a varying distance from the wall 35 of the compression chamber 36.

The pump further includes a discharge plenum 40 and a suction plenum 46. Discharge plenum 40 communicates with compression chamber 36 through a discharge port 42. Discharge valve 44 is seated over discharge port 42 within discharge plenum 40. Suction plenum 46 communicates with compression chamber 36 through suction port 48. Suction valve 51 is seated over suction port 48 within compression chamber 36. The suction valve 51 and the discharge valve 44 and the ports, including the suction port 48 and the discharge port 42 are tuned in operation as described below. In alternative embodiments, the number of suction and discharge valves can be altered and their geometry and size can be changed as well.

The clearance volume is minimized by the way in which piston cap 34 fits into compression chamber plate 28. Clearance volume, in this embodiment, is further reduced by the curved section 27 of compression chamber plate 28, the curvature of the curved section is chosen to conform to the bending profile of diaphragm 24 at the top of the discharge stroke. Various curvatures of the curved section 27 can be utilized of the compression chamber plate 28 depending on variations in the bending profile of diaphragm 24 in various embodiments. If desired, a straight wall could be utilized although it is recognized that performance characteristics would likely suffer with the use of a straight walled section in place of the curved section 27.

Still referring to FIGS. 1 and 2, the pump 2 further includes a motor 50. In this embodiment, motor 50 is a variable reluctance motor having an E-shaped stator 52, a stator coil 54 being wound around the center leg of stator 52, and an armature 56. Stator 52 and armature 56 are each formed by a stack of individual laminations in order to reduce the eddy current losses associated with oscillating magnetic fields in metals. Armature 56 is rigidly connected to piston 30 by stud 58. The armature 56 and piston 30 act as an moving portion to move the diaphragm 24 between the first positions and second positions.

Figure 9:
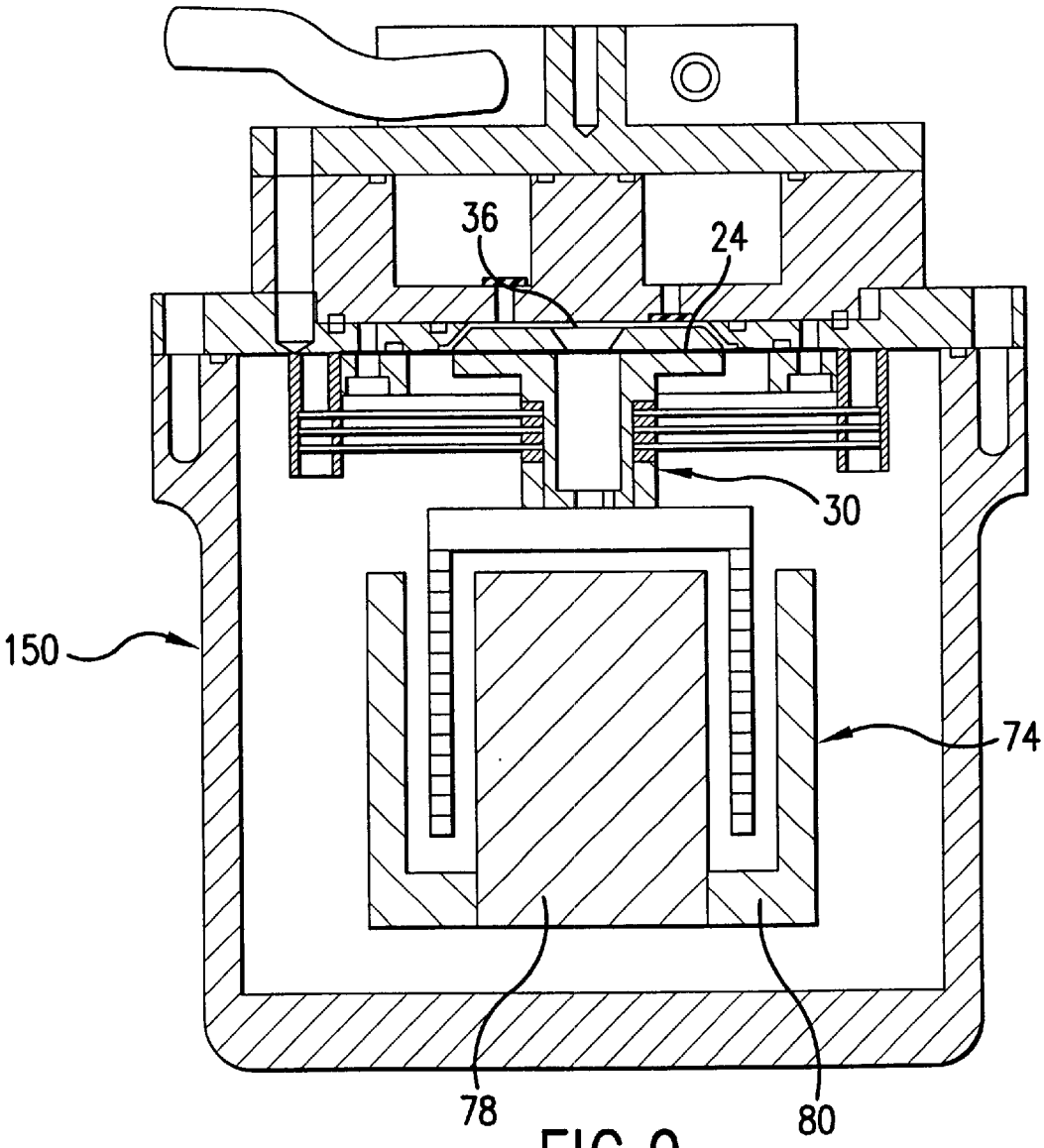
FIG. 9 is a third embodiment of the present invention illustrating the use of a voice-coil linear motor.
Figure 10:
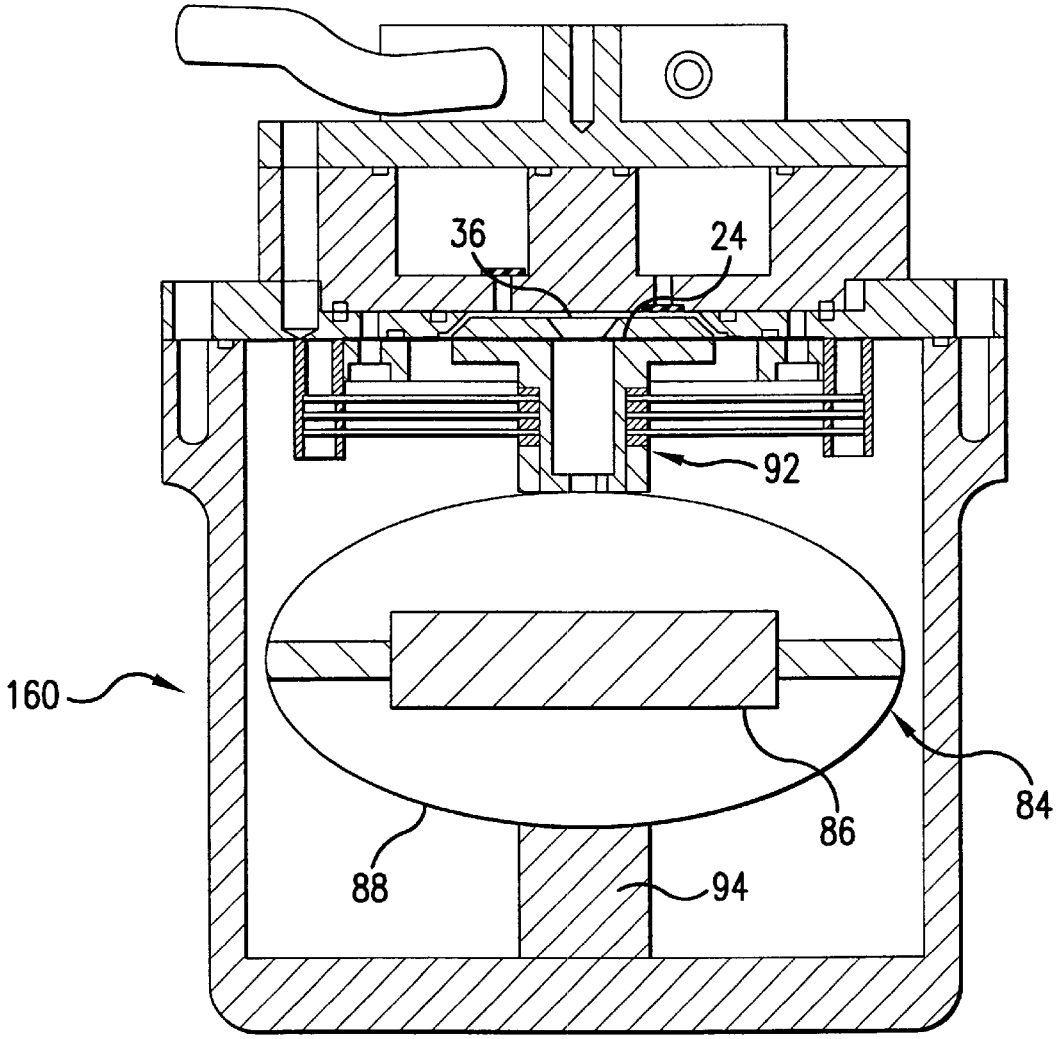
FIG. 10 is a fourth embodiment of the present invention illustrating the use of a piezoelectric linear motor.

Leaf springs 60 are rigidly connected to piston 30 and to compression chamber plate 28 so as to allow axial motion of armature 56 and piston 30, while serving to reject non-axial motions. A plurality of leaf springs 60 (60*a*, 60*b* and 60*c*) attached to the piston and the enclosure 4. The leaf springs 60 serve as a part of the mechanical spring to provide restoring force and displacement to the piston 30 and diaphragm 24 during actuation. Stator 52 is rigidly connected to an enclosure 55 and enclosure 55 is rigidly connected to compression chamber plate 28. The enclosures 55 provides a chamber to provide back pressure against the diaphragm 24. In other embodiments, various type of motors can be used including a voice coil motor as illustrated in the embodiment in FIG. 9, a piezoelectric element as shown in the embodiment of FIG. 10 and in other embodiment motors such as piezo bender bimorphs; electrostatic, electrostrictive, ferroelectric, and rotary off-concentric motors.

Figure 2A:
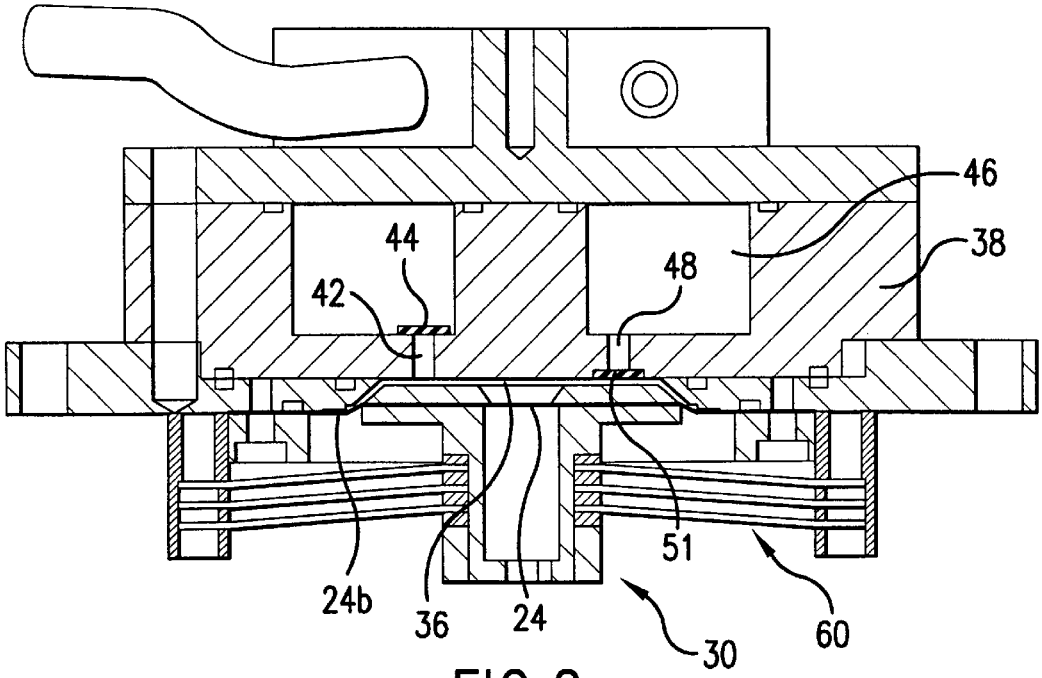
FIG. 2*a* is an enlarged cross sectional view of the gas compressor of FIG. 1 at the end of the discharge stroke.

Operation of the compressor 2 of FIGS. 1 and 2 is described with respect to FIGS. 2, 2*a*, 2*b*, 2*c*, and 2*d* as follows. As shown in FIG. 2*a*, a suction cycle begins with the piston 30 at the top of its stoke in a first position proximal to the valve head 38. When the piston 30 is in its first position, the compression chamber 36 is at its minimum volume. The volume of the compression chamber 36 varies as the piston 30 cyclically moves between its first and second positions. The volume displacement of the present invention can be calculated from standard piston compressor equations by substituting the diaphragm's effective diameter $d_e$ for the piston's diameter. The effective diameter $d_e = d + \frac{1}{3}(D-d)$, where d is the diameter of the piston 34 and D is the diameter of clamp ring 26. The swept volume then becomes $V = sd_e$, where s=the piston stroke.

Figure 2B:
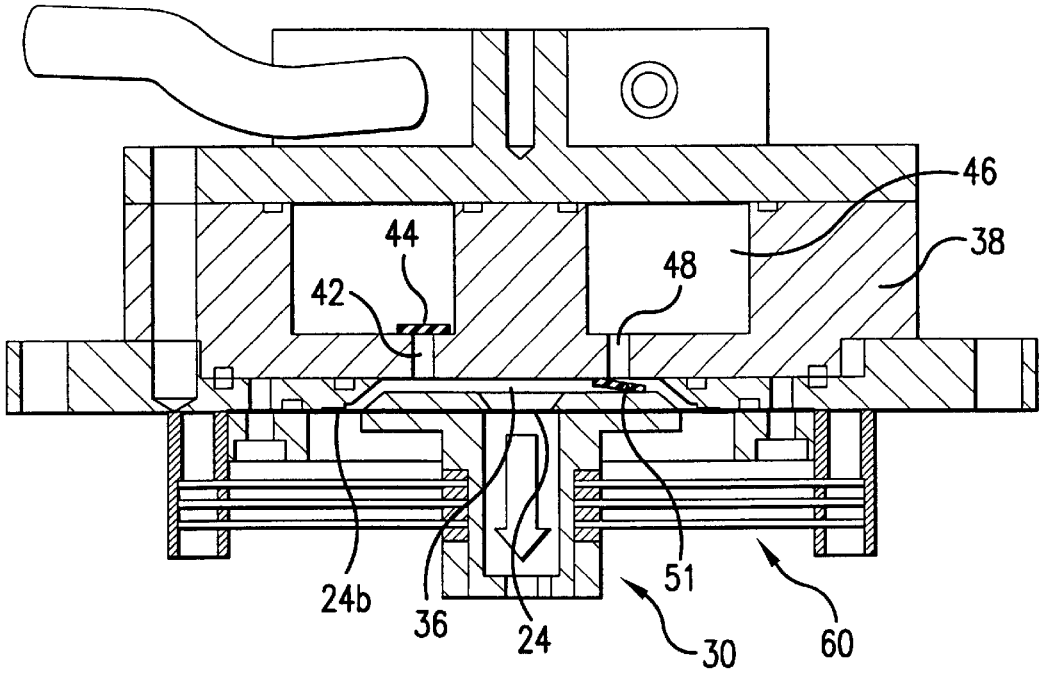
FIG. 2*b* is an enlarged cross sectional view of the gas compressor of FIG. 1 at the mid-point of the suction stroke.
Figure 2C:
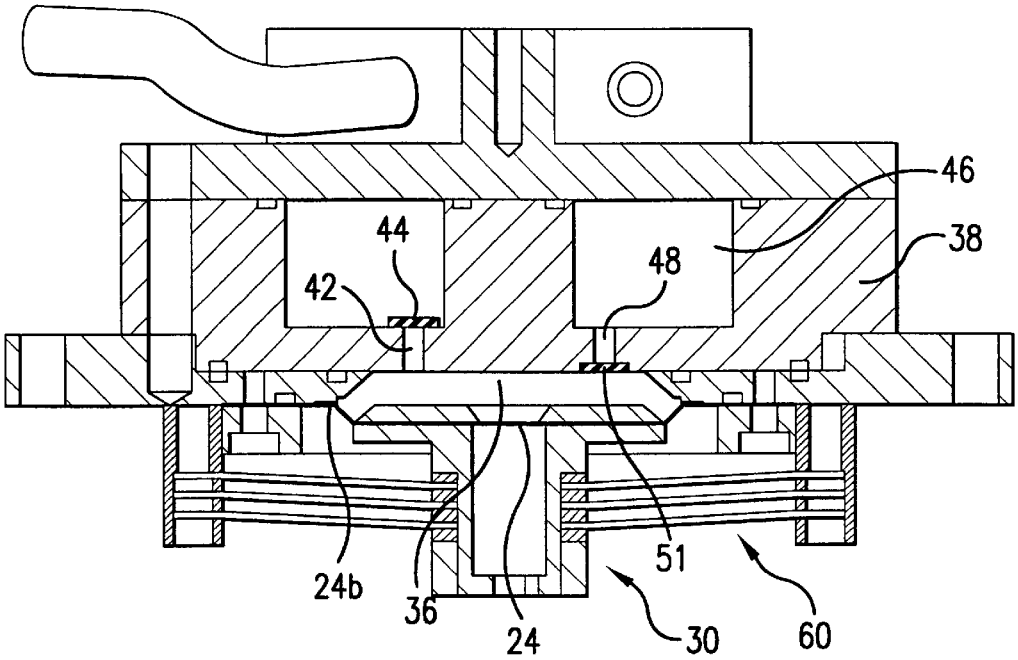
FIG. 2*c* is an enlarged cross sectional view of the gas compressor of FIG. 1 with the piston at the beginning of the discharge stroke.

A periodic voltage applied to coil 54 creates a magnetic attractive force between stator 52 and armature 56. This magnetic force combines with the restoring force of the deflected leaf springs 60 and restoring force of the remaining compressed gas within compression chamber 36, thereby causing the piston 30 to move away from valve head 38. The resulting downward motion of piston 30 and diaphragm 24 causes the volume of compression chamber 36 to increase, thus causing the pressure within compression chamber 36 to drop below the pressure within suction plenum 46. The resulting pressure differential causes the suction valve 51 to open, thereby allowing low pressure gas to flow from suction plenum 46 into compression chamber 36 as shown in FIG. 2*b*. On the suction stroke, the piston 30 continues through the equilibrium position or middle station as shown in FIG. 2*b*. The piston 30 continues its movement past the middle station until eventually the restoring force of the diaphragm 24, the rarified gas, and the leaf springs 60 reach a magnitude adequate to halt the piston 30, thereby ending the suction cycle with the piston 30 and diaphragm 24 in its second position distal from the valve head 38 or top wall portion 35 of the compression chamber 36 as shown in FIG. *2c*.

Figure 2D:
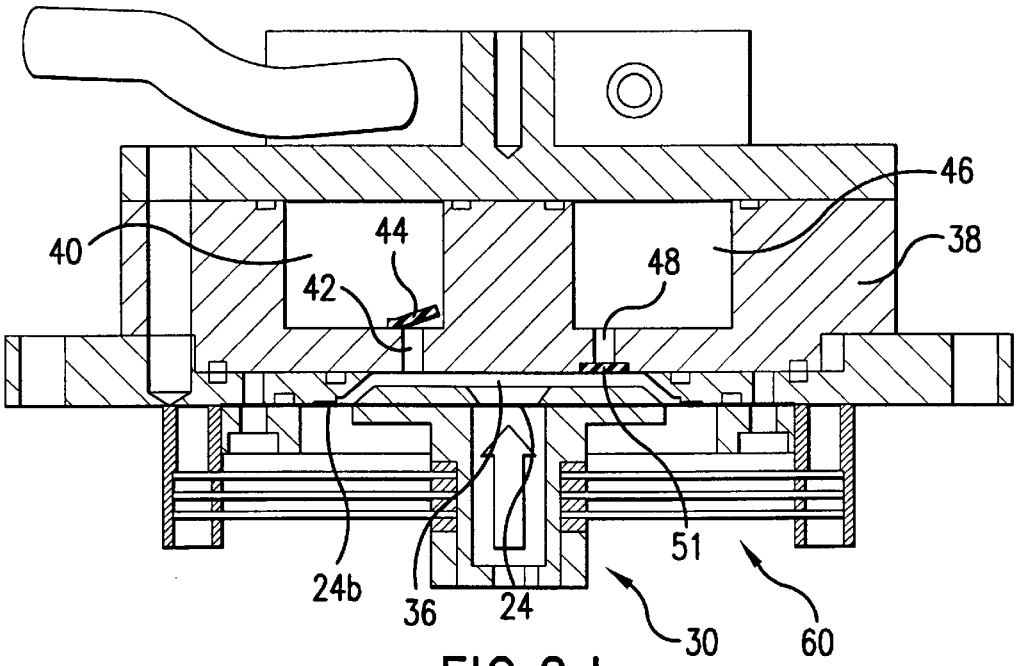
FIG. 2*d* is an enlarged cross sectional view of the gas compressor of FIG. 1 with the piston at mid-point of the discharge stroke.

For the discharge cycle or compression cycle, the voltage across coil 54 is reduced creating a corresponding reduction in the attractive force between the stator 52 and the armature 56. The restoring force of the diaphragm 24 and leaf springs 60 then causes armature 56 and piston 30 to reverse directions, whereby piston 30 and diaphragm 24 begin to move towards the valve head 38 and the compression cycle begins. The upward compression stroke of piston 30 and diaphragm 24 causes the volume of compression chamber 36 to decrease, thus causing the pressure within compression chamber 36 to rise above the pressure within discharge plenum 40. The resulting pressure differential causes the discharge valve 44 to open, thereby allowing high-pressure gas to flow from compression chamber 36 into discharge plenum 40 as shown in FIG. 2*d*. On the compression stroke, the piston 30 continues through the equilibrium position, as shown in FIG. 2*d*, until the combined forces of the diaphragm 24, the leaf springs 60, the compressed gas, and the increasing force of motor 50 cause the piston 30 to reverse directions, thereby ending the discharge cycle in the first position as shown in FIG. 2*a*. The particular phase, between the applied periodic voltage waveform and the reciprocation of piston 30, is determined by the masses, mechanical spring characteristics, gas spring characteristics, damping, and the characteristics of the pumping load. As the piston 30 and diaphragm 24 cycle between discharge and suction cycles, the piston 30 moves between various first positions of varying distances from the wall portion 35 of the compression chamber 36 as well as various second positions of varying distances from wall portion 35 as shown in FIGS. 2*a* and 2*d* depending on the specific operating conditions.

Resonant Operation

Figure 4:
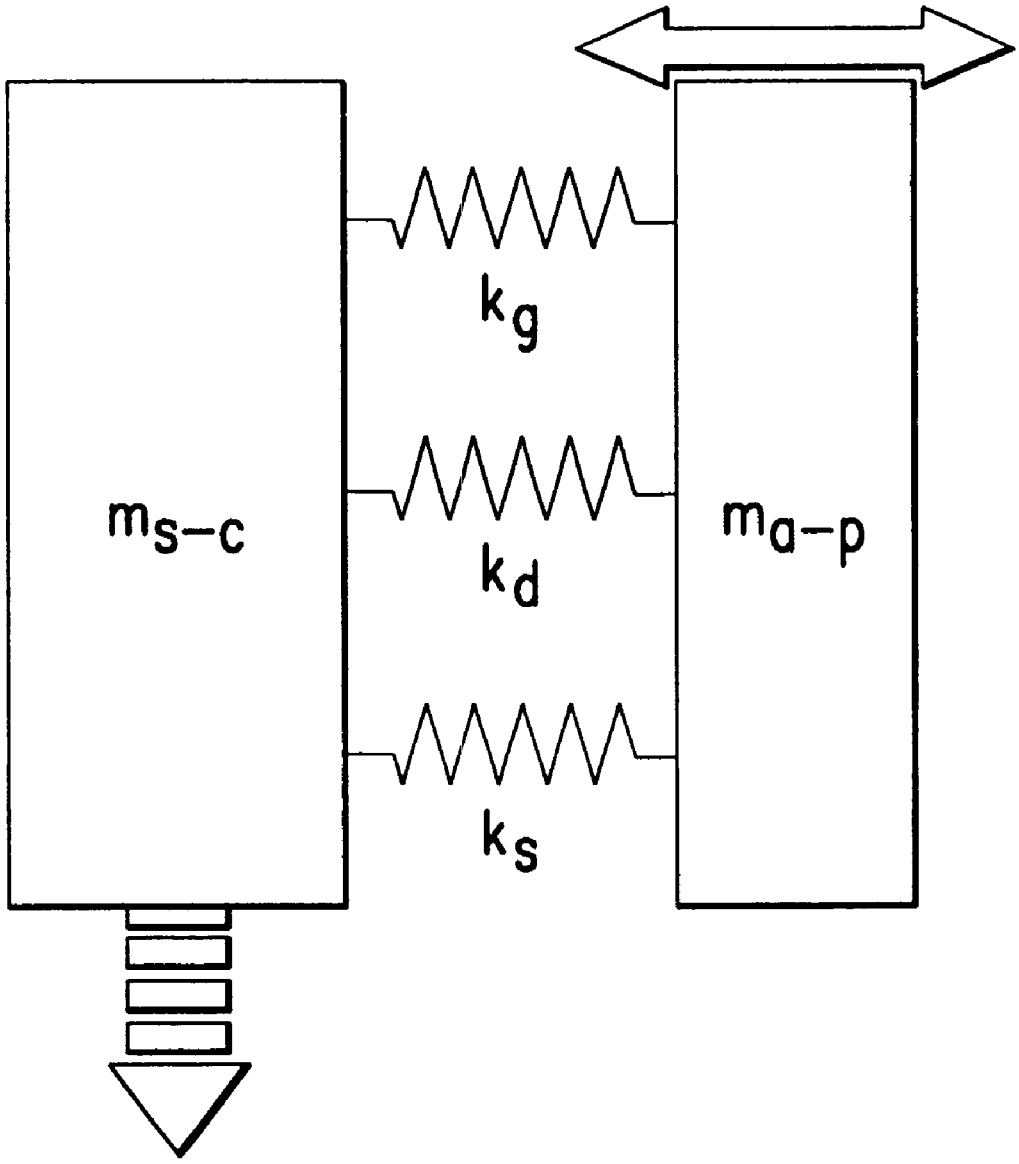
FIG. 4 is lumped element diagram illustrating the different springs that influence the system dynamics of the gas compressor of FIG. 2.

Referring now to FIG. 4, during operation of the pump 2 of FIGS. 1 and 2, different springs and masses influence the dynamics of the compressor 2 of FIG. 2. These springs include the compressed gas G, the diaphragm 24 and the mechanical leaf springs 60 and are described as $k_g$ which is the spring constant of the compressed gas, $k_d$ which is the spring constant of the diaphragm, $k_m$ which is the spring constant of the mechanical leaf springs 60, and masses including masses described where $m_{s-c}$ is the mass of the stator 52 and all of the other stationary parts of compressor 2, and $m_{a-p}$ is the mass of the moving armature and piston. It is understood that the diaphragm 24 also contributes a portion of its mass to the moving mass $m_{a-p}$. In the embodiment of FIGS. 1–2 of the present invention, the values of $k_g$, $k_d$, $k_m$, $m_{s-c}$ and $m_{a-p}$ are all chosen to create a mass-spring resonance of the piston 30 having a mechanical resonance frequency $f_0$ that is close to the driving frequency of the motor 50. In this embodiment, $m_{s-c}$, will be much larger than $m_{a-p}$ in order to minimize the vibration of the compressor 2 such that $f_0 \approx 1/(2\pi)[(k_g+k_d+k_m)/m_{a-p}]^{1/2}$, for $m_{a-p} << m_{s-c}$. In alternative embodiments various combinations of spring stiffnesses and masses can be selected to create a mass-spring resonance of the piston or other actuator.

The pump 2 is desirably operated at a frequency that is less than its mechanical resonance frequency. Such operation provides several advantages. Since the restoring forces of the springs contribute to the force required to move the piston 30, the inertia of the moving mass is effectively reduced, thereby reducing the actual motor force required for a given compression. At the high-frequency resonance of the pump of the present invention, the diaphragm 24 stroke required for a given compression ratio is reduced, when compared to non-resonant diaphragm compressors such high frequencies are considered to be at frequencies of 100 cycles per second or greater. This allows the present invention to provide high compression ratios without exceeding the fatigue limits of the diaphragm 24. For example, for pump sizes less than ½ horsepower, the pump of the embodiment of FIGS. 1 and 2 of the present invention has provided compression ratios of 6. Other diaphragm compressors have typically been limited to lower compression ratios of only 3. The pump of the present invention can be scaled in size to provide a range of pumping power ratings.

A stroke length is defined as the displacement of the piston between the second position at the end of a suction stroke and the first position of the top of the successive compression stroke. Since the compressor can produce high compression ratios with very short stroke, motors are used that can efficiently provide short strokes and high forces. The stroke ratio is defined as the stroke length divided by the diameter of the moving portion shown as the diaphragm in FIG. 1 and 2. The compression ratio is defined as the sum of the swept volume in the compression chamber plus a clearance volume divided by the clearance volume. For example, in the embodiment described in FIGS. 1 and 2 piston 30 is operable with stroke lengths of up to 0.10 inches for corresponding diameters of piston 30 of between 1.5 inches and 4.75 inches where the pump is operable with stroke ratio between about 0.07 and 0.02 and discharges fluid at a pressure of 30 to 80 psi.

Pumps with high compression ratios necessitate a stiff diaphragm material that will not overly flex under high pressure, since this could result in over-stressing the diaphragm and degradation of the compression ratio. In the pump 2 of the embodiment of FIG. 1 and 2, the pump operates with low diaphragm strokes afforded by high-frequency resonant operation. Such operation makes it possible to use the all-metal diaphragm 24 as used in the embodiment of FIGS. 1 and 2, thereby providing the stiffness needed for high compression ratios. Such metal diaphragms provide stability and long life in high-pressure applications. Such metal diaphragms have advantages over prior diaphragms made of rubber in certain application because the metal diaphragms are not susceptible to cracking, weakening, degradation or failure when exposed to high pressure conditions or corrosive gases during operation or due to other reactivity or compatibility issues. Further such metal diaphragms are not permeable by gases and thereby do not allow for undue gas pass thru and resulting pressure build up a back side of the diaphragm. The diaphragms of alternative embodiments using other materials will similar properties can be used. In alternative embodiments, the diaphragm may be provided or suitable materials including metals such as steels, stainless steels and alloys, aluminum, titanium, magnesium, brass, copper, other materials such as carbon fibers, composite materials or like materials with desired flexibility, stability and durability when exposed to various gases, liquids or refrigerants that may be used with the pump. Further, in various alternative embodiments, elastic material diaphragms, including diaphragms made of various polymers like rubber, can be used in applications that do not require high pressure or pose problems with permeability, corrosion of degradation of the polymer material in the diaphragm or where durability considerations are not important. The pump 2 of the embodiment of FIGS. 1 and 2 also provides the opportunity of high frequency operation and corresponding size reduction of compressors for a given pumping capacity, since pumping capacity=frequency×swept volume×volumetric efficiency. The pump 2 of the present invention has no sliding seals but uses the flexible diaphragm 24. The pump 2 makes high frequency operation practical by means of the greatly reduced diaphragm strokes provided at resonance, and by the relatively low mass of the moving elements. So, at higher frequencies, the swept volume of the pump can be reduced, since there is a greater number of pumping cycles-per-second. For example, the pump 2 in embodiment of FIGS. 1 and 2 has a swept volume of 1.05 $in^3$ with 200 pumping cycles-per-second. The pump can be scaled to provide various pumping capabilities. The pump 2 has overcome prior difficulties in practice with other compressor technologies. Typically, energy efficiency is inversely proportional to size, since the swept volume falls off faster than frictional losses as a compressor is scaled down.

Valve Tuning

The dynamic tuning of the valves and valve ports illustrated in the embodiment of FIGS. 1–2 as discharge valve 44, suction valve 51, suction port 48 and discharge port 42 provide important aspects of the dynamic resonance operation of the pump according to the present invention. This tuning of the ports and valves provides an additional component of the resonance operation beyond the role of the acoustic or pneumatic spring in conjunction with the mechanical springs 60 and diaphragm 24 in determining the resonance operating characteristics and resulting advantages.

In standard compressors, the valves typically have been quite large in order to provide the most efficient switching or checking action with minimum pressure loss. Because of the large and relatively soft nature of the valves, mechanical valve stops often have been employed to limit their motion. The valves 51, 44 and associated ports 48, 42 also play a crucial role in maintaining the acoustic/pneumatic spring and associated resonance character under a wide range of conditions. The preferred valve design 51, 44, therefore, requires a balance between optimizing resonance behavior and minimizing the flow pressure loss.

Figure 12:
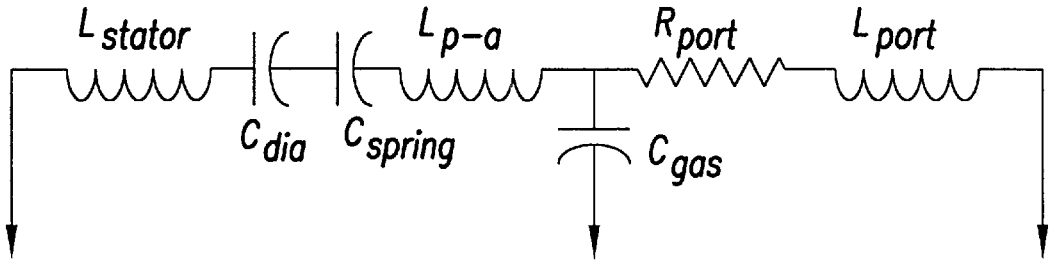
FIG. 12 is a simplified lumped element diagram illustration of the system dynamics.

FIG. 12 is a simplified electrical analogue schematic of the system dynamics including the influence of a single port and illustrates the necessity for proper valve tuning at high pumping frequencies. In the electric-to-mechanical analogue, the paired analogies are current flow-to-fluid flow, inductance-to-inertance, capacitance-to-compliance, resistance-to-resistance. The circuit branch that represents the compression chamber and motor includes components $L_{stator}$ (motor stator), $C_{dia}$ (diaphragm), $C_{spring}$ (mechanical leaf springs), $L_{p\text{-}a}$ (for combined piston and armature mass), and $C_{gas}$ (compression chamber gas). The circuit branch that represents the single port includes components $C_{gas}$, $R_{port}$, $L_{port}$. It can be seen immediately from the electrical analogue schematic that the resonant amplitude can be enhanced or degraded depending on the component values of the port branch. By properly designing the geometry of the ports 42, and 48 including the shape, length and cross-sectional area, the ports 42, and 48 can be tuned, thus the fluid inertance and flow resistance can be controlled so as to provide the desired balance between pump flow rate and compression ratio (i.e. resonance amplitude). The model shown in FIG. 12 can be extended to include a second port, dynamic valves coupled to the ports that add a rectification to the flow, and the dynamic fluid pressure forces acting to open and close the valves. Appropriate formulas for determining the numerical values of the inertance and resistance are widely known in the art.

Increasing the overall impedance of the valves 44, 51 and ports 42, 48 increases the amount of residual gas contained in the compression chamber after the discharge cycle. The increased gas containment provides increased acoustic spring rates. The overall impedance is generally increased by reducing the diameter or cross-section of ports 42, 48, increasing the port length, increasing the valve spring stiffness, or decreasing the number of valves. Since inertance and resistance are out of phase with each other, changing the relative ratio of inertance to resistance alters the timing of the port flow relative to the piston motion. More resistance and less inertance causes the valve flow to be in closer phase with the compression chamber pressure. Conversely, increasing the inertance relative to the resistance causes a phase shift of valve-port flow away from maximum pressure toward maximum piston velocity. By proper tuning of the ports 42, 48 and valves 44, 51, the flows impedance can be used to create more efficient scavenging and filling of the compression chamber. Changing the mass of the valve relative to its diameter has a similar impact on the inertance.

Figure 13:
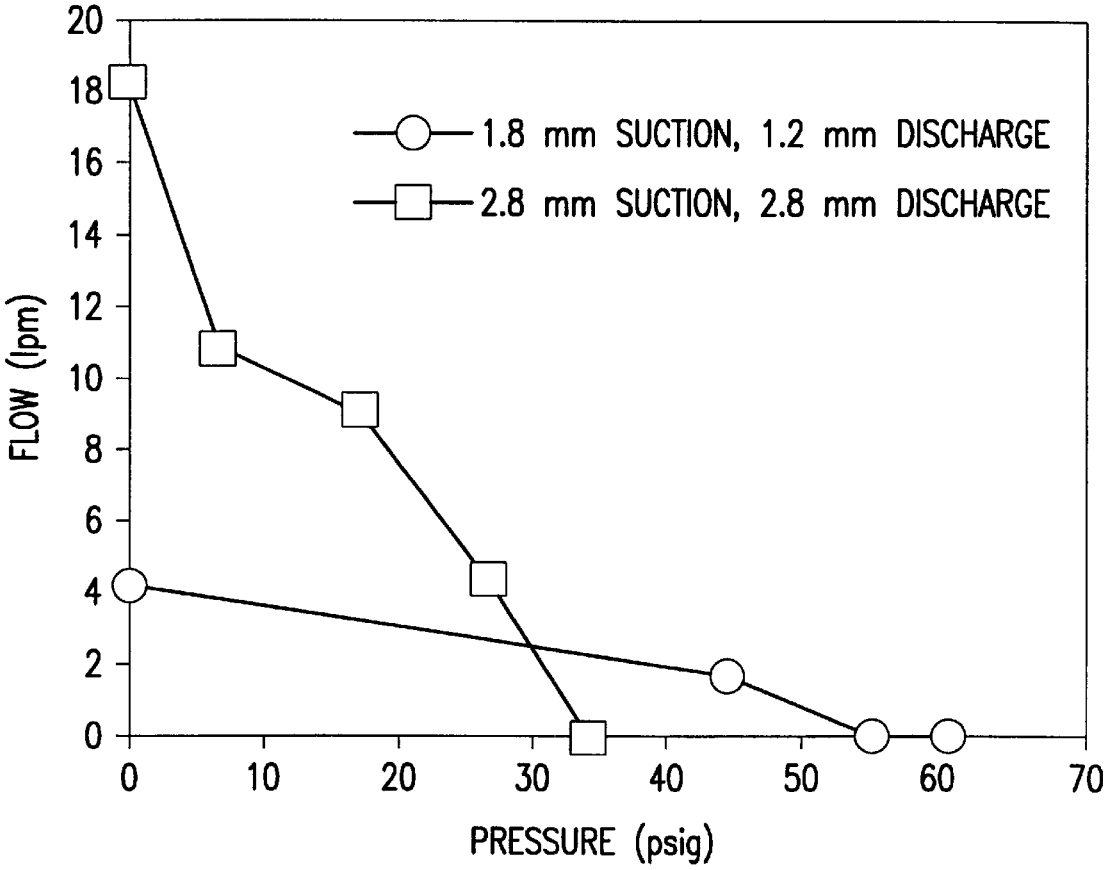
FIG. 13 is a chart of pressure vs. flow performance curves.

FIG. 13 illustrates the effect of valve-port tuning on compressor performance. The two performance curves represent identical design characteristics of a pump according to the present invention with the exception of valve port diameter. In one case, the valve port diameter is 0.10 inch while in the other it is 70% increased at 0.17 inch. The smaller, more restrictive ports provide increased maximum pressure at the expense of less maximum flow. The ideal valve-port geometry is maximized for the particular pump and motor geometry as well as the requirements of specific applications.

Tuning the valves 44, 51 provides control of when the valves 44, 51 open during a pumping cycle and also when the valves close during a pumping cycle. This is very important for pumping efficiency and for valve life and reliability. For example, valves that open late will shorten the valve duty cycle and result in less flow per pumping cycle, which reduces efficiency. Valves that close late will allow back flow through the valve, which reduces efficiency. Back flow may also be a source of contamination in some applications.

During an ideal valve duty cycle, the fluid pressure differential across the valve is relatively small. After the ideal valve duty cycle, the pressure differential across the valve increases rapidly. A late closing valve will be driven to high velocities by this large pressure differential and will experience large impact stresses upon striking the valve seat, which leads to failure and low reliability. Conversely, a properly timed closing will occur with much lower impact velocities providing for long valve life.

Inertance, and its influence on valve timing, becomes increasingly important as valve operating frequencies are increased. At low valve frequencies, steady-state flow is established early in the valve duty cycle and remains relatively constant throughout the duration of the valve duty cycle. The initial transient where the gas is accelerating comprises a small fraction of the duty cycle. Thus, the gas inertance associated with that valve design is insignificant. For these frequencies, incompressible flow calculations provide fairly accurate predictions of performance.

At high frequencies, however, the gas may continue to accelerate through a significant portion of the valve duty cycle, reaching steady state for only a brief portion of the duty cycle or perhaps not at all. Consequently, inertance becomes significant in characterizing the valve's performance and timing at these higher frequencies where the flow is predominately in the incompressible regime. The pump 2 in the present invention preferably operates at high frequencies where the tuning of the valves 44, 51 and ports 42, 48 provides additional benefits. The valves that are properly tuned for higher operating frequencies tend to be smaller then other compressor valves. This provides greater flexibility for the designer in laying out the valve design and provides the potential for more total valve area.

The tuned ports 42, 48 and valves 44, 51 of the pump 2 of the present invention also eliminate the need for valve stops. Typically, compressor valves are designed for much lower frequency operation. At lower frequencies, a valve's opening time and closing time is a small fraction of it open duty cycle. As such, pressure and flow forces hold the valves open against a valve stop for most of the valve duty cycle. The tuned valves 44, 51 of the pump of the present invention open and close in one continuous motion and thus eliminate the need for valve stops. This also eliminates the valve impact stresses associated with valve stop impacts, thereby improving valve life and reliability.

The valves 44, 51 can be tuned for high flow at low compression ratios or low flow at high compression ratios. The larger valve ports will support higher flow rates but will reduce the compression ratio. Smaller ports will reduce the flow rate but provide larger compression ratios.

The tuned valves of the pump of the present invention also provide high compression ratios with small diaphragm displacements. Conventional diaphragm pumps would use larger strokes to provide higher compression ratios. High compression ratios can be provided with valves that are tuned to provide the proper flow resistance. This reduces the diaphragm stroke required for high compression ratios and results in reduced diaphragm bending stresses and consequent high diaphragm reliability. Also, reducing the diaphragm stroke reduces the force needed to deflect the diaphragm. Thus, more motor force can be directed to compressing the gas rather than bending the diaphragm, resulting in higher energy efficiency.

It is important to understand that the use of valves in combination with ports provides superior performance at lower frequencies. Since the fluid inertance associated with the ports increases with operating frequency, the timing of flow through the ports can be tuned at higher frequencies so as to provide a net flow through the pump without valves. The advantages of tuned ports and valves can be realized by any pump that can operate at high frequencies. Thus, a piston, rotary, diaphragm, or any other pump can benefit from the tuned port and tuned valve approach of the present invention.

Stability

The pump 2 has improved stability compared to free-piston compressors as both the mechanical springs 60 of FIG. 2 and the spring contribution of diaphragm 24 provide distinct stability advantages over free-piston compressors. Since the mechanical springs will always provide a restoring force, the mechanical resonant frequency can be maintained within a useful operating frequency range for a wide range of compression ratios and flow rates, by choosing the appropriate mechanical spring constants. The pump of the present invention thus provides important advantages over free piston compressors in allowing the pump to operate at or below mechanical resonance without requiring various electromechanical and/or fluidic controls to stabilize the mean piston position.

Figure 2E:
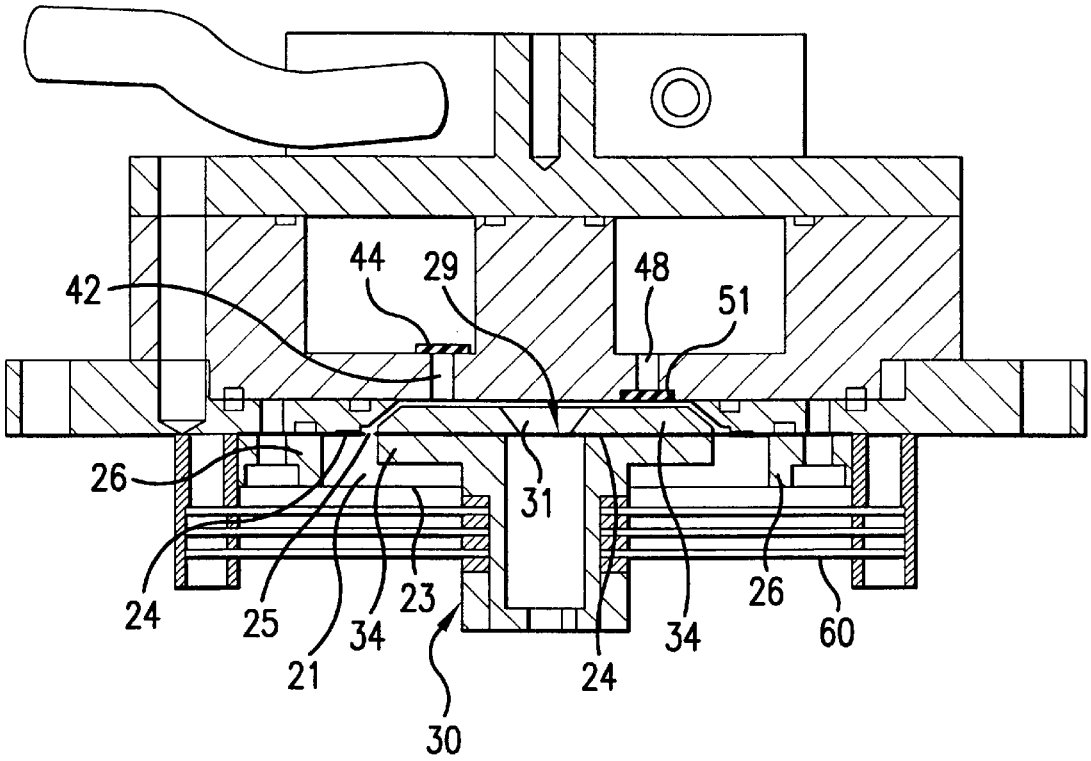
FIG. 2*e* is an enlarged cross sectional view of the gas compressor of FIG. 1 with a hole in the diaphragm.

As shown in FIG. 2*e*, the embodiment of FIGS. 1 and 2 of the present invention can be provided with a hole 25, shown in the diaphragm 24 to enhance stability. The hole 25 is placed in the embodiment of FIG. 2*e*, in the area of diaphragm 24 between the inner diameter of clamp 26 and the outer diameter of piston cap 34 of FIG. 2*e*. When the pressure-related forces on both a front or first face 29 and a back or second face 31 of the diaphragm 24 are balanced, then the stress on the diaphragm 24 is reduced, thus providing greater reliability and longer life for the diaphragm. Under certain pressure conditions, a diaphragm without a hole may be susceptible to breaking or cracking due to the high-pressure conditions. The pressure equalization provided by hole 25 prevents the mean position or middle station of the diaphragm 24 from creeping, which would cause performance to be degraded due to a closing of the motor's average air gap, and reduced efficiency due to excess clearance volume, and reduced compression ratios.

The diaphragm hole diameter is chosen so as to provide a gas flow-rate time-constant that is typically 8 or more pumping cycles in duration. Longer or shorter time constants can be used at the cost of reduced performance. This hole 25 is sized to provide a leak path between compression chamber 36 and the interior 57 of enclosure 55 in FIG. 2. The appropriate size of hole 25 can be determined from orifice flow calculations once the pressure differential across the hole and the volume of enclosure 55 is known. Prototypes of the linear resonance pump have shown optimal performance for hole diameters of 8–30 mils. In alternate embodiments, a plurality of holes can be provided when the number and site of the holes being selected on the same criteria as described with respect to hole 25 of FIG. 2*e*. In such alternative embodiments, the hole can be provided in components other than the diaphragm 24 that provide a leak path between the compression chamber 36 and the interior 57 of the enclosure 55 provide fluid flow through the hole to equalize pressure of the first and second faces of the diaphragm 24.

If a hole 25 is added to diaphragm 24, then an all metal wetted flow path can be maintained by providing a second diaphragm 23 or other barrier which forms a small backing volume 21 or backpressure chamber as shown in FIG. 2*e*. In this way, pressure equalization across diaphragm 24 is provided by pressurizing the backing volume 21, rather than pressurizing the entire interior volume 57 of enclosure 55. A smaller backing volume also allows the diameter of hole 25 to be reduced. In the embodiment of the pump 2 as shown in FIG. 2*e*, the all-metal wetted flow path of the fluid includes the discharge plenum 40, discharge port 42, suction plenum 46, suction port 48, compression chamber 36, second diaphragm 23 and hole 25. As well, the presence of an all-metal wetted flow path, allows the pump 2 to be used with a wide range of fluids and promotes chemical compatibility with high-purity, toxic, reactive, or environmentally hazardous fluids. In alternate embodiments where an all-metal wetted flow path is not required, the second diaphragm 23 can be eliminated utilizing the interior motor area as the diaphragm backing volume.

Diaphragm Dimensions

Figure 5:
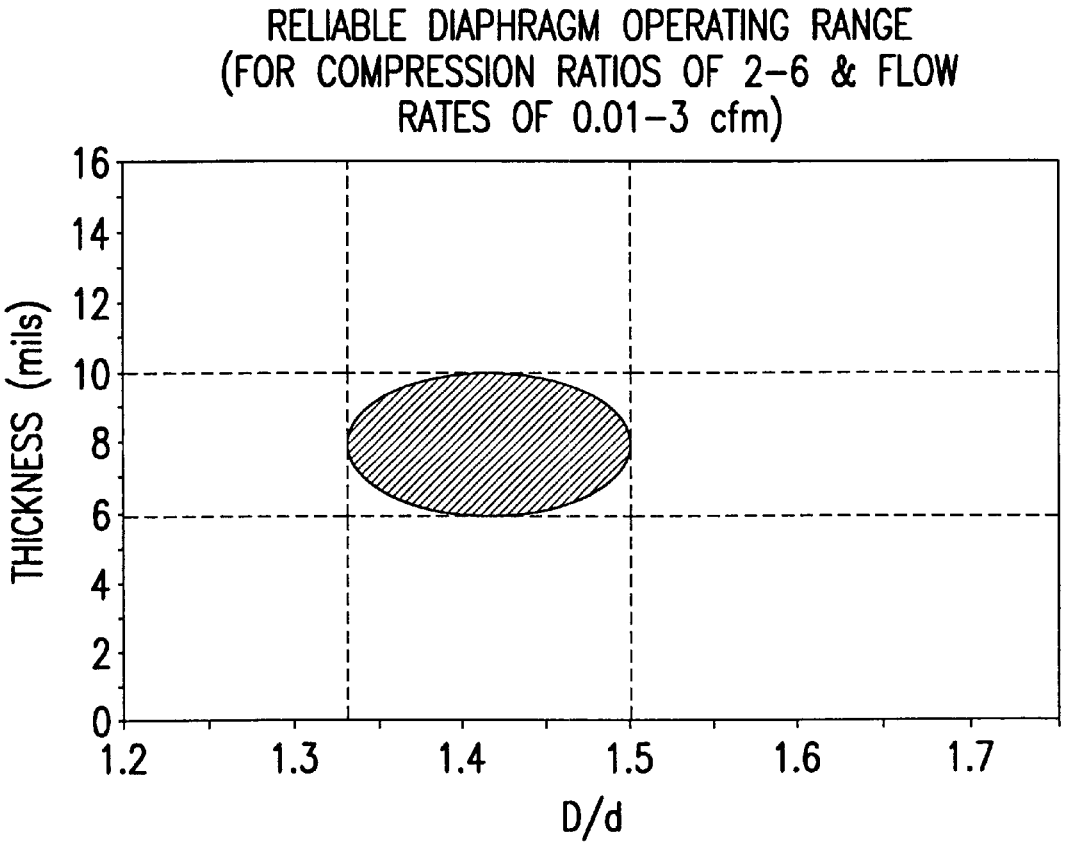
FIG. 5 is a chart of diaphragm design parameters.

Turning to FIG. 5, a chart of diaphragm design parameters with a shaded area that represents a region of desired life and reliability for embodiments where the fluid is a gas. Extended life and reliability of diaphragms can be achieved with proper design. The critical parameters that can be used to describe the diaphragm are its thickness t, outer clamped diameter D, and inner clamped diameter d. In FIG. 2, D is the inner diameter of clamp ring 26 and d is the outer diameter of piston cap 34.

The life and reliability of the diaphragm are preferably within a D/d ratio range of 1.25–2.00 and a thickness range of 4–20 mils. For operating conditions that span compression ratios of 2–6 and flow rates of 0.01–3.0 cfm, life and reliability are maximized for a D/d ratio range of 1.33–1.50 and a thickness range of 6–10 mils. The shaded area in FIG. 5 shows this region of preferred dimensions although other regions can be utilized. High compression ratios would move the design parameters into the upper left hand region of the shaded area and low compression ratios would move the design parameters into the lower right hand region of the shaded area. The embodiment of FIGS. 1 and 2 of the present invention uses a diaphragm thickness of 8 mils and a D/d ratio range 1.33–1.50.

The thickness of the diaphragm 24 can also be reduced due to the presence of the hole 25 which reduces the average pressure differential across the diaphragm. As the bending stresses in the diaphragm increase with the thickness cubed, reducing the diaphragm thickness reduces bending stress and increases life and reliability of the diaphragm. The addition of the leaf springs 60 to the diaphragm as the principle mechanical spring also allows the pump to be operated with greater stability and efficiency over a larger range of diaphragm stokes. This is in part due to the fact that diaphragm springs are nonlinear (i.e. the deflection force is not $F=kx$ but rather is $F=kx^n$) and leaf springs 60 are more linear than a diaphragm spring. As shown in the embodiment of the pump according to FIGS. 1 and 2, multiple level leaf springs 60 (60*a*, 60*b*, 60*c*) are utilized. The use of multiple leaf springs 60 provide significantly more stability than either a single or multiple diaphragm springs. The use of these leaf springs provides improved stability and greater rejection of non-axial motions of the piston-armature assembly. The leaf springs 60 also provide increased reliability as they are less susceptible to being deformed by an annular buckling than a diaphragm utilized as a mechanical spring in isolation. As depicted, the leaf springs 60 are preferably provided outside of the compression chamber 36, so stresses due to pressure deformation can be ignored in their design providing for simplicity of design.

Diaphragm Displacement

The volume displacement of the present invention can be calculated from standard piston compressor equations by substituting the diaphragm's effective diameter $d_e$ for the piston's diameter. The effective diameter $d_e=d+\frac{1}{3}(D-d)$, so that the swept volume $V=sA_e,=s(\pi/4)(d_e)^2$ where d≡the piston diameter, D≡inner diameter of clamp ring 26, and s≡the piston stroke. For the embodiment of FIG. 2 typical values would be d=4.75" D=6.0" s=0.050" yielding a swept volume of 1.05 $in^3$.

Electronic Controls

During operation, variations can occur in the spring stiffness $k_g$ of the gas being compressed within compression chamber 36, and due to changes in compression ratio and flow rate. Spring constants $k_g$, $k_d$, and $k_m$ can all change due to their nonlinearity with displacement. Thus, the mechanical resonance frequency $f_0=1/(2\pi).\ (k_t/m_{a\text{-}p})^{1/2}$ (where $k_t$≡spring constant sum, $m_{a\text{-}p}$≡total moving mass), will change as pressures and displacements change. These pressure and displacement variations can occur due to system-imposed changes or by user-imposed changes such as variable capacity. For applications where operating conditions cause $f_0$ to vary, an electronic control can be used to make corresponding changes in the drive frequency in order to maintain a given offset between the drive frequency and the changing mechanical resonance frequency.

Figure 6:
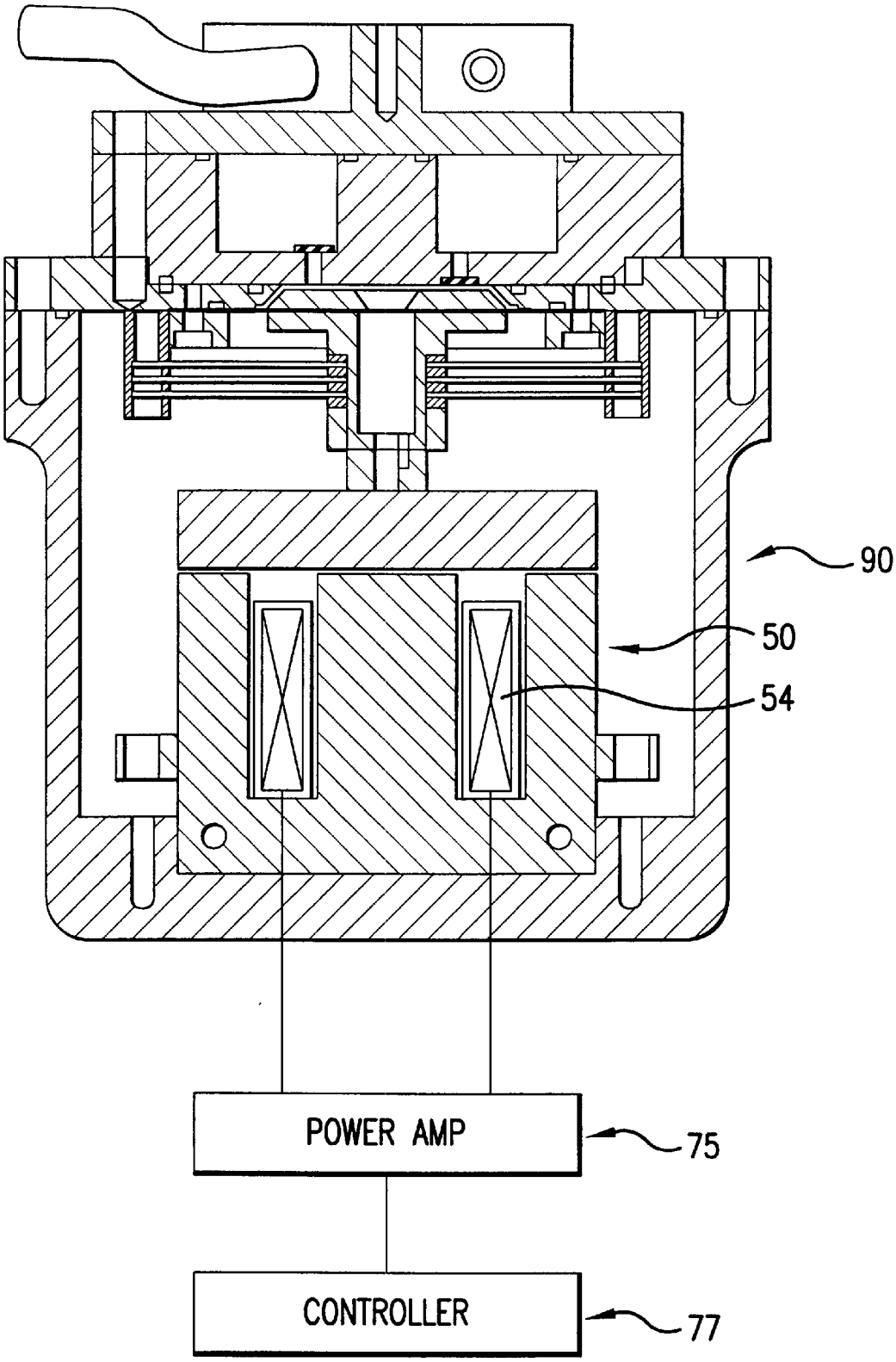
FIG. 6 provides a block diagram of control electronics for the compressor of FIGS. 1–2.
Figure 7:
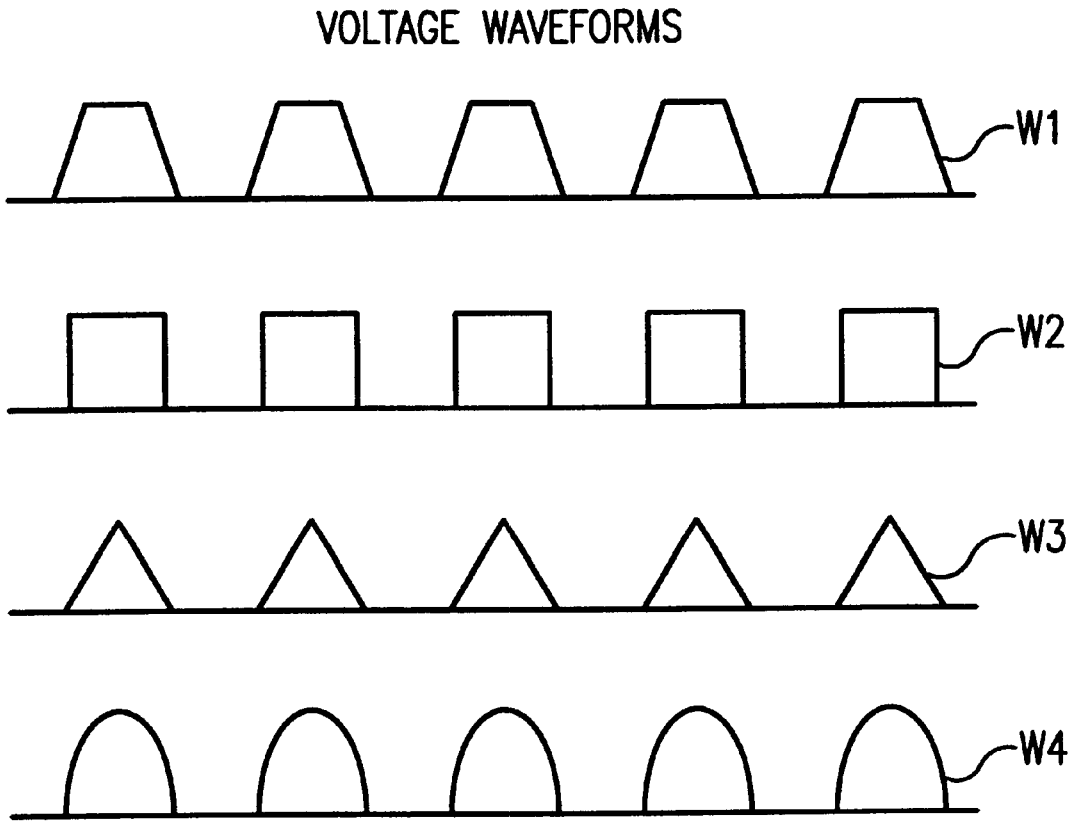
FIG. 7 illustrates selected voltage waveforms that can be used to drive the variable reluctance motors of the present invention.

FIG. 6 illustrates a pump 90 having a motor 50 as described with respect to the embodiment of FIG. 1 connected to a power amp 75, which drives the stator coil 54 and a controller 77 for changing the drive frequency in response to changes in $f_0$. FIG. 7 illustrates four of many different voltage waveforms W1, W2, W3, W4 that can be used to drive the stator coil 54 of FIG. 6. Closed-loop and/or open-loop methods also can be used with various embodiments to adjust the drive frequency during operation. For applications where operating conditions are very stable or where peak performance is not a priority, a fixed-frequency drive can be used and the controller eliminated.

In embodiments of the pump utilizing the closed-loop method, controller 77 could vary the drive frequency of power amp 75 in order to maximize power transfer to the motor winding 54. The closed loop controller can be provided to find a desired drive frequency, based on a measured discharge pressure, which maximizes the power consumption for a fixed drive voltage and to operate the motor on such drive frequency. An alternate embodiment could use another feedback scheme of maximizing the pressure or flow. Controller 77 could use, for example, a microprocessor based search algorithm. This closed loop controller could find a desired drive frequency of the motor to maximize flow or pressure at a fixed drive voltage in response to measured operating condition. Still further, a closed loop controller can be provided that is operatively connected with the motor for varying the drive frequency of the motor in responses to changes in the mass-spring mechanical resonance frequency.

Other methods known to one of skill in the art can be used for closed-loop method controllers in still further embodiments.

In embodiments of the pump utilizing the open-loop method, controller 77 varies the drive frequency of power amp 75 according to a predetermined mapping of the compressor's performance characteristics. In response to a given drive amplitude signal, controller 77 would select an ideal drive frequency from its characteristic performance map data. For example, higher compression ratios will cause the mechanical resonance frequency to shift up. In response, the controller would prescribe a higher drive frequency based on the performance map data.

Figure 8A:
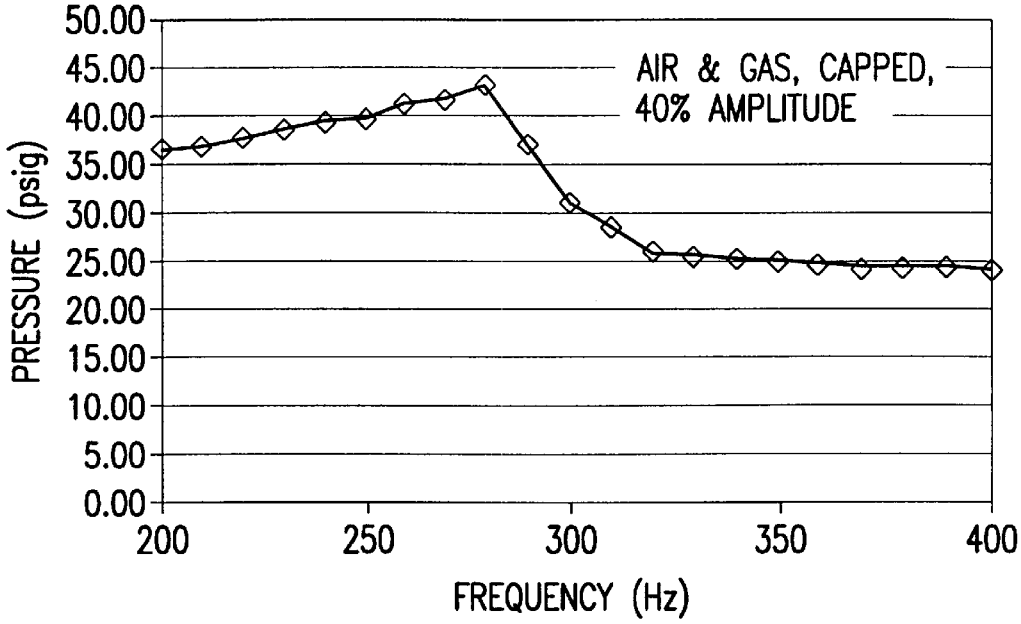
FIGS. 8*a* and 8*b* provides two charts that show pressure and power frequency response of the compressor of the present invention.
Figure 8B:
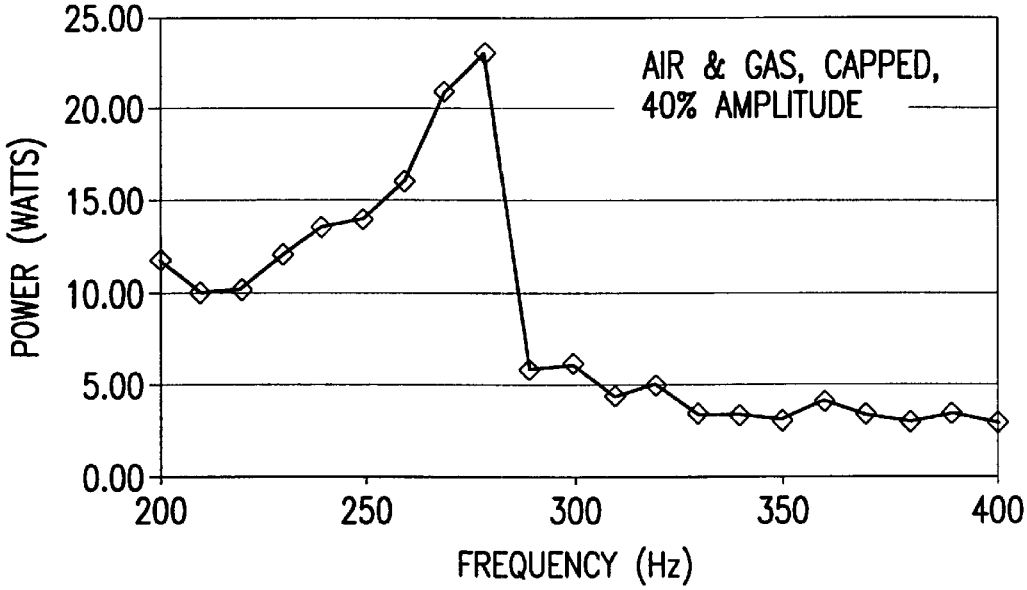

Control stability, for a linear resonance pump, is enhanced when the drive frequency is below the peak of the mechanical resonance frequency $f_0$. FIG. 8 shows the pressure and power frequency response. These curves illustrate the hardening nonlinearity of the resonance, and thus the preference for operating the pump at a frequency below the resonance peak.

The degree to which the drive frequency of a particular controller will be offset from the mechanical resonance frequency depends on the requirements of a given application. The frequency offset between the mechanical resonance frequency and the drive frequency is a compromise between optimum performance and acceptable stability. Within the scope of the present invention, a continuum of frequency offsets can be used with a corresponding continuum of stability vs. performance, and thus the benefits of resonant operation can be realized at various drive frequencies spanning a large portion of the mechanical resonance curve. In the preferred embodiment, the drive frequency is below the mechanical resonance frequency and varies across the range of 0.5–0.95 of the mechanical resonance frequency based on specific operating conditions. While other embodiments can be operated at other drive frequencies spanning different ranges of the mechanical resonance curve.

Fixed displacement compressors often create an undesirable current in-rush, or current spike, upon start-up while the motor comes up to operating speed. Since the displacement of the pump of present invention is variable, soft start-ups can be provided by slowly increasing the drive voltage amplitude of the motor 50, thereby avoiding the sudden load that can lead to current spikes. The elimination of current spikes provides a distinct advantage for applications such as refrigeration systems on boats. The boats electrical system must be rated to withstand the compressor's current spikes. This can result in having to size the electrical supply system to handle currents that are many times the steady-state current draw of the compressor resulting in significant additional expense.

Many electronic control schemes and specific components can be used to detect and maintain the proper drive frequency.

Refrigerant Compressor

Figure 3:
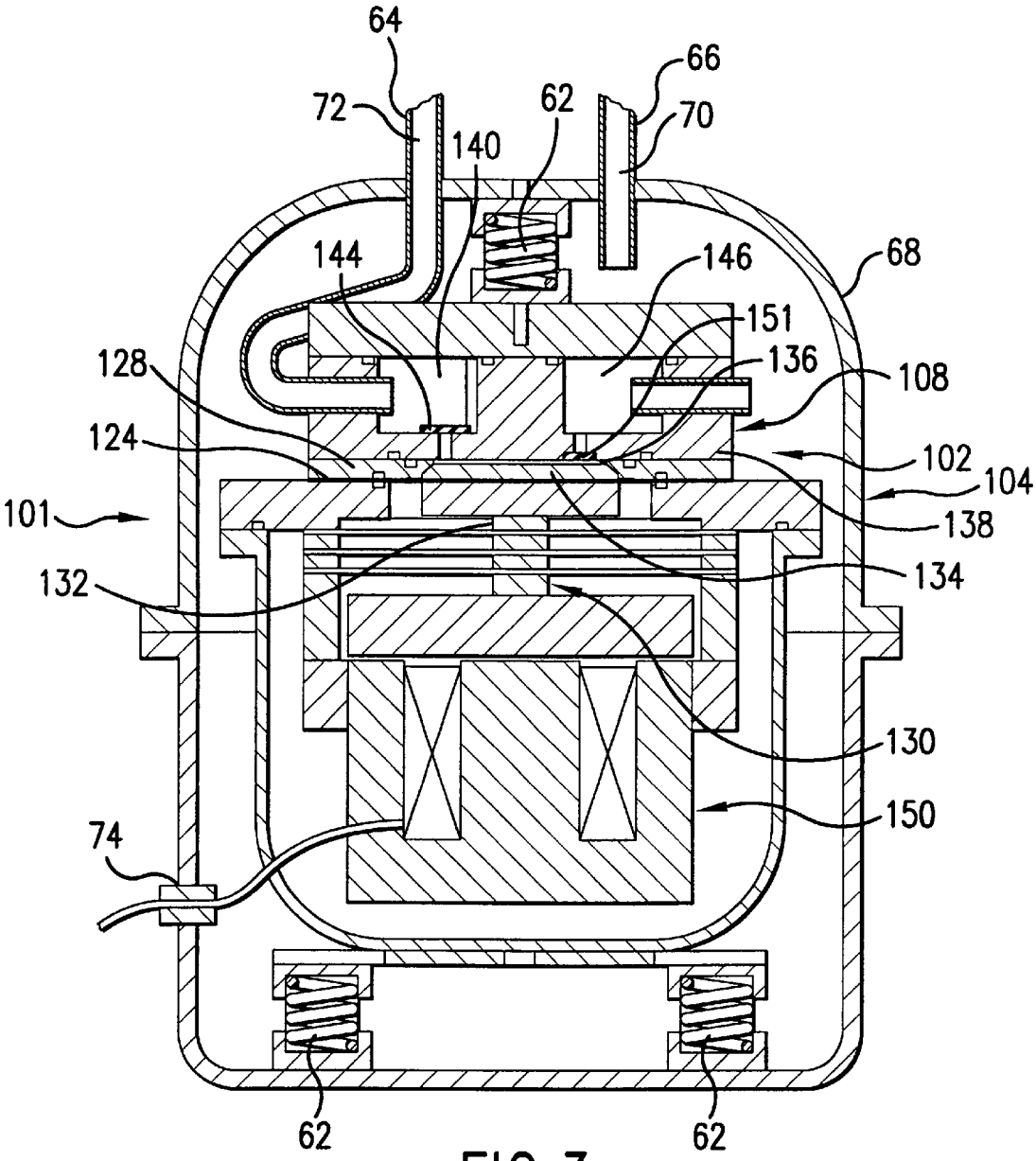
FIG. 3 is a cross-sectional view of a second embodiment of a refrigerant compressor in accordance with the present invention.

Turning now to FIG. 3, another embodiment of the pump according to the present invention is depicted in the form of a refrigerant compressor 102 for the compression of phase change refrigerants used in vapor-compression heat transfer systems. To the extent similar, like elements of the embodiment of the pump 101 of FIG. 3 as a refrigerant compressor are as described with respect to the description of the pump 2 of FIGS. 1 and 2. While functionally similar to the compressor of FIG. 2, some design modifications are required to meet the hermitic sealing and refrigerant compatibility requirements of the typical vapor-compression application. Such design and operation differences are described. Significant differences include the use of metal compression springs 62 for the suspension elements and the use of metal copper tubing for the discharge tube 64 and suction tube 66. In addition, the two halves of the enclosure 68 may be joined by welding or brazing and the compressor inlet port 70 and outlet port 72 sealed by brazing in order to provide a hermetic seal. Like FIGS. 1 and 2, the pump 101 further includes a motor 150. Electrical connection is made by way of a standard hermitic electrical pass-through 74 in the enclosure wall.

Like the embodiment of FIGS. 1 and 2, the pump 101 includes a pump or compressor 102 suspended in an enclosure 104. However, the suspension is accomplished by suspension 106 in the form of metal compression springs 62. The suspension elements positions the compressor 102 both radially and axially within the enclosure 104 and prevents contact between the compressor 102 and the inner surfaces of enclosure 104 during operation. The refrigerant compressor 102 also comprises two main sub-assemblies, the pump head 108 and the motor 150 with similar elements as described in the FIGS. 1 and 2. The description for like elements is incorporated by reference.

The pump head assembly 108 includes a similar diaphragm 124, which is positioned and secured in a similar manner as described with respect to FIGS. 1 and 2. The pump head assembly 108 also comprises a similar valve head 138 and a piston 130 including a piston base 132 and a piston cap 134. During operation, piston 130 and diaphragm 124 operate in similar respect to the air compressor of FIGS. 1 and 2. Still referring to FIG. 3, the pump 102 further comprises a similar compression chamber 136 that is formed by components including piston cap 134, diaphragm 124, compression chamber plate 128, and a valve head 138. The pump further includes a similar discharge plenum 140 and a suction plenum 146 with discharge value 151 and suction valve 144.

Suitable refrigerants that can be used with the pump 102 include R134A, R410A (CFC), R12, R22, R600A (isobutene); R280 (isopropane); R407; hydroflurocarbons and like refrigerants. The operation of the pump in FIG. 3 can be operated in accordance with the operation of the pump in FIGS. 1 and 2 applying principles of compression of refrigerants as known by those of skill in the art of compressors for refrigerators. The advantages of the present invention, for vapor-compression heat transfer systems, are a wide range of refrigerant compatibility due to oil-free operation and variable capacity.

Linear Motors

The linear motors shown in the embodiments of FIGS. 1, 2, 3, and 6 are all of the variable reluctance type. Variable reluctance motors (like those shown in FIGS. 1 & 2) can provide large forces over a small stroke. For a fixed current, the force of such variable reluctance motors increases with the inverse square of the air gap. So, they become much more efficient at creating force as the air gap is reduced. However, other positive displacement compressors require large strokes that would require large air gaps for a variable reluctance motor resulting in low motor efficiency. Conversely for the pump 2, valve tuning, resonance, and high frequency operation all work synergistically to provide flows and pressures with comparatively small strokes. Thus, the pump 2 according to the present invention enables the efficient utilization of variable reluctance motors providing a commercial benefit due to the higher energy efficiency of smaller air-gaps and ease of construction of such variable reluctance motors.

The preferred embodiment of the pump uses a square wave (waveform W2 in FIG. 7) to drive the variable reluctance motor. The higher the drive voltage the more efficient the motor, since the delivered power=current× voltage and part of the motor's losses go with $I^2R$. So, the coil is sized to the highest available voltage.

In alternative embodiments, any type of linear motor that provides the required displacement and force can be employed. Due to the low strokes of the pump, other types of high-force low-stroke motors such as magnetostrictive and piezoceramic motors can be provided. The selection of a given motor would be determined by the pump's operating frequency and size. For example, variable reluctance motors are well suited to larger units that operate at lower frequencies and piezoceramic motors may be better suited to miniaturized units with very small strokes and much higher frequencies. Turning to FIG. 9, an alternate embodiment of the pump 150 of the present invention is shown using a more conventional voice-coil linear motor 74, having a voice-coil 76, permanent magnet 78, and pole piece 80. The voice-coil linear motor 74 provides the same function as motor 50 of FIG. 2, but unlike variable reluctance motors it can provide both push and pull forces to drive the piston. The voice coil driver is more readily available than the motor of FIGS. 1 and 2, and may be considered for some applications.

FIG. 10 illustrates still another alternate embodiment of the present invention having a pump 160 with a linear motor 84, having a piezoelectric element 86, and an elliptically-shaped mechanical displacement amplifier 88 being rigidly connected to piston 92 and rigidly connected to mounting stud 94. The description of like elements from the embodiment of the pump in FIG. 1 and 2 is incorporated by reference with respect to this embodiment. Alternatively, piezoelectric element 86 could also be a magnetostrictive element. In operation, piezoelectric element 86 alternately expands and contracts in response to an applied periodic voltage. The displacement provided by piezoelectric element 86 is increased, or amplified, by mechanical displacement amplifier 88. Displacement amplifier 88 is constrained by mounting stud 94 so that all of the displacement is applied to piston 92. Alternatively, mounting stud 94 could be removed and linear motor 84 could operate in a reaction force mode. In alternative embodiment, any type of linear motor that provides the required displacement and force can be employed.

Figure 11:
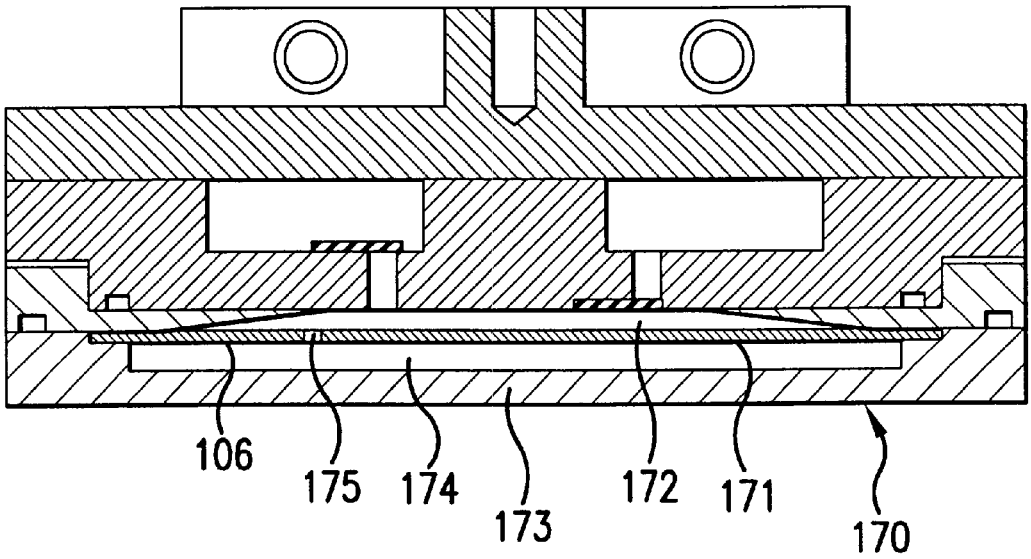
FIG. 11 is an embodiment of a piezo-electric motor.

FIG. 11 illustrates a further alternative embodiment of the present invention comprising a pump 170 having a piezoceramic bi-morph diaphragm 171, compression chamber 172, a diaphragm backing plate 173, backing volume 174, and diaphragm hole 175. Bi-morph diaphragm 171 replaces motor 50, leaf springs 60, and associated linkage components. Resonant operation is achieved by choosing a spring stiffness for diaphragm 171 that, in combination with the gas spring stiffness, would provide a mechanical resonance at or near the desired operating frequency. Diaphragm hole 175 provides pressure equalization between compression chamber 172 and backing volume 174 as described in the previous embodiment of FIG. 2*e*. The simplicity and reduced number of components of the embodiment of FIG. 11 lends itself to miniaturization and to applications fields such as MEMs technology. As with other alternative embodiments, the description of like elements from the embodiment of FIGS. 1 and 2 are incorporated by reference with respect to pump 170.

Liquids

The linear resonance pump of the present invention can be designed in another embodiment to pump gases or liquids and the tuning of the system will generally reflect the compressibility of the fluid. For example, as the compressibility of the fluid decreases, the volume of the compression chamber can be increased to keep the resonance frequency constant. The volume would have to be increased roughly by $(\alpha_{f1}/\alpha_{f2})^2$, where $\alpha_{f1}$≡sound speed in fluid 1, and $\alpha_{f2}$≡sound speed in fluid 2. So changing from gas to liquid would require roughly an order of magnitude volume increase in order to keep the running frequency constant. Further tuning could involve adjusting the spring stiffness of the diaphragm and mechanical springs as well as the mass of the oscillating components. In this way, the linear resonance pump can be designed to accommodate not only gases, but a wide range liquids such as water, fuel, oils, hydraulic fluid, and high-purity or hazardous chemicals, to name a few.

The foregoing descriptions of the preferred embodiments of the invention have been presented for purposes of illustration and description. It is not intended to be exhaustive or to limit the invention to precise form disclosed, and obviously many modifications and variations are possible in light of the above teaching. The embodiments were chosen and described in order to best explain the principles of the invention.and its practical application to thereby enable others skilled in the art to best utilize the invention in various embodiments and with various modifications as are suited to the particular use contemplated. Although the above description contains many specifications, these should not be construed as limitations on the scope of the invention, but rather as an exemplification of alternative embodiments thereof. There are many ways to exploit the new features of the present invention that will readily occur to those skilled in the art of pump and compressor design and electromechanical design. The present invention can be scaled up or down in size as will be evident to those skilled in the art. The present invention can be used in closed cycle systems as well as open systems. It is intended that the scope of the invention be defined by the claims appended hereto.

That which is claimed:

1. A pump for compressing a fluid comprising:

a pump head comprising, a compression chamber comprising a wall having a geometry defining a partial enclosure with an opening and a flexible diaphragm rigidly connected at an outer perimeter of the opening of the wall, the diaphragm having a flexible portion capable of moving with respect to the outer perimeter between a plurality of first positions and a plurality of second positions, the wall and the diaphragm in the first positions and second positions defining first and second volumes of said compression chamber;

a suction port connected in communication with the compression chamber for flowing a fluid into the compression chamber;

a discharge port connected in communication with the compression chamber for flowing the fluid out of the compression chamber;

a fluid spring comprising the fluid within said compression chamber subject to varying pressure and flow conditions;

a mechanical spring comprising said diaphragm;

a motor having a moving portion being operatively connected to the diaphragm for oscillating the diaphragm at a drive frequency for compressing the fluid, a combined moving mass of said diaphragm and said moving portion, and said mechanical spring and said fluid spring defining a mass-spring mechanical resonance frequency greater than the drive frequency.

2. A pump according to claim 1, wherein said motor is a variable reluctance motor.

3. A pump according to claim 1, wherein said wall of the compression chamber further comprises a curved wall section, and the flexible portion of the diaphragm being free to flex to generally conform in shape to the curved wall section for minimizing clearance volume in the compression chamber as the moving portion cycles to the plurality of first positions.

4. A pump according to claim 1, wherein the first positions are proximal to said wall of the compression chamber at the top of a respective compression stroke, and the second positions are distal to said wall of the compression chamber at the end of a respective suction stroke, and wherein said diaphragm is operably movable to at least two of the plurality of the first positions on successive compression strokes and to at least two of the plurality of the second positions on successive suction strokes in response to varying drive force from said motor, the diaphragm in at least two of the plurality of first positions being a varying distance from the wall of the compression chamber and in at least two of the plurality of the second positions being a varying distance from the wall of the compression chamber.

5. A pump according to claim 4, wherein said diaphragm cycling between the plurality of first positions of varying distance from said wall on the successive compression strokes and cycling between the plurality of second positions on the successive suction strokes provides a change in flow rate of the fluid during successive cycles.

6. A pump according to claim 1, wherein said diaphragm further includes a first face within the compression chamber and a second face outside of an interior of the compression chamber, and said pump further comprises an exterior chamber in fluid communication with the second face of the diaphragm, and said pump further comprises a hole extending between and in communication with said compression chamber and said exterior chamber, said hole having a geometry sized and selected to communicate a sufficient quantity of fluid through said hole between said compression chamber and said exterior chamber for equalizing pressure on the first and second faces of said diaphragm.

7. A pump according to claim 6, wherein said hole is positioned in said diaphragm.

8. A pump according to claim 6, where said hole has a diameter sized to provide a fluid flow-rate time-constant of 8 or more pumping cycles in duration.

9. A pump according to claim 7, wherein said diaphragm further comprises a plurality of holes, the number and geometry of said holes being selected to communicate a sufficient quantity of fluid through the hole for equalizing pressure on the first and second faces of said diaphragm.

10. A pump according to claim 7, wherein said diaphragm is formed of a metal, and said pump further comprises a metal sealed backpressure chamber in fluidic communication with the second face and said hole, wherein an all-metal wetted flow path is provided for flow of said fluid during compression.

11. A pump according to claim 1, said suction port and said discharge port each having a geometry comprising diameter, length and cross-sectional shape, the geometry of each of the suction port and the discharge port being selected to coordinate the filling and discharge of the fluid flow through the suction port and the discharge port in coordination with the pressure cycle in the compression chamber to provide a net flow in one direction of the fluid within the pump.

12. A pump according to claim 11, wherein the pump head further comprises a suction valve operatively connected to the suction port and a discharge valve operatively connected to the discharge port, said suction valve and said discharge valve each having a predetermined stiffness and a valve duty cycle, wherein the suction valve prevents flows through the suction port in a closed position and allows flow through the suction port in an open position and the discharge valve prevents flow through the discharge port in a closed position and allows flow through the discharge portion in an open position, and wherein the valve stiffness and size of the discharge valve and the suction valve each being selected to tune the suction valve and discharge valve such that the timing of the duty cycles of the suction valve and the discharge valve are coordinated with the timing of the filling of fluid flow through the suction port and the discharge of the fluid flow through the discharge port and the pressure cycle in the compression chamber to provide a net flow in one direction of the fluid within the pump.

13. A pump according to claim 12, wherein each of the suction valve and the discharge valve are adapted to be maintained in the open position by fluid pressure differential across the respective valve during flow and absent any mechanical stops.

14. A pump according to claim 13, wherein said valves are adapted to open and close through each of the valve duty cycles in a continuous motion.

15. A pump according to claim 1, wherein said diaphragm and said moving portion are operable free of external lubricants for said diaphragm.

16. A pump according to claim 1, wherein the pump is operable at frequencies of 100 cycles per second or greater to produce desired fluid compression.

17. A pump according to claim 1, further comprising control means operatively connected with the motor for varying the drive frequency to oscillate the diaphragm at a frequency that is less than the mechanical resonance frequency.

18. A pump according to claim 17, wherein said control means further comprises a closed loop controller operatively connected with the motor for varying the drive frequency of the motor in response to changes in the mass-spring mechanical resonance frequency.

19. A pump according to claim 18, wherein said closed loop controller further comprises:

means for measuring discharge pressure of the fluid from the port; and means for varying the drive frequency in response to the measured discharge pressure in order to maximize the measured discharge pressure.

20. A pump according to claim 18, wherein said closed loop control means further comprises:

means for measuring selected operating conditions in the pump;

means for varying the drive frequency of the motor in response to the measured operating conditions in order to maximize the measured operating conditions.

21. A pump according to claim 17, further comprising an open loop controller operatively connected with the motor for varying drive frequency of the motor, the open loop controller having:

means for inputting a measured drive amplitude;

means for comparing the inputted drive amplitude with a predetermined performance map to determine a desired drive frequency for operating the motor in accordance with changes in the mass-spring mechanical resonance frequency; and means for varying the drive frequency of the motor to the desired drive frequency.

22. A pump according to claim 1, wherein said diaphragm has a D/d ratio between 1.25–2.0 wherein D is the diameter of the diaphragm and a thickness range of 4–20 mils.

23. A pump according to claim 1, wherein the fluid is a gas.

24. A pump according to claim 1, wherein the fluid is a liquid.

25. A pump according to claim 23, wherein said fluid is a selected from the group consisting of air, hydrocarbons, process gases, high-purity gases, hazardous and corrosive gases toxic fluids, high-purity fluids, reactive fluids and environmentally hazardous fluids.

26. A pump according to claim 24, wherein the fluid is a liquid selected from the group consisting of fuels, water, oils, lubricants, coolants, solvents, hydraulic fluid, toxic or reactive chemicals.

27. A pump according to claim 1, wherein said mechanical spring further comprises a leaf spring connected with said moving portion of the motor for providing restoring force and displacement of the moving portion during cycling of the moving portion.

28. A pump according to claim 27, wherein said leaf spring is connected with the moving portion outside the compression chamber.

29. A pump according to claim 1, wherein said motor is selected from a group consisting from the group of motors having a piezoelectric element or a voice coil linear motor.

30. A pump according to claim 1, wherein said compressor can operate in any gravitational orientation.

31. A method of compressing a fluid using a pump comprising:

providing a pump for compressing a fluid, said pump comprising;

a pump head comprising;

a compression chamber including a wall having a geometry defining a partial enclosure with an opening and a flexible diaphragm rigidly connected at an outer perimeter after the opening of the wall, the diaphragm having a flexible portion capable of moving with respect to the outer perimeter between a plurality of first positions and a plurality of second positions, the wall and the diaphragm in the first and second positions defining first and second volume of the compression chamber;

a suction port connected in communication with the compression chamber for flowing a fluid into the compression chamber;

a discharge port connected in communication with the compression chamber for flowing the fluid out of the compression chamber;

a fluid spring comprising the fluid within said compression chamber subject to varying pressure and flow conditions;

a mechanical spring comprising said diaphragm;

a motor having a moving portion being operatively connected to the diaphragm for oscillating the diaphragm at a drive frequency for compressing the fluid;

introducing a fluid into the compression chamber at a first pressure, wherein the fluid acts as a fluid spring under varying pressure conditions;

determining a mass-spring mechanical resonance frequency by the combine moving masses of the moving portion of the motor and the diaphragm and by the mechanical spring and the fluid spring;

operating the motor at a drive frequency that is less than the resonance frequency a the mechanical resonance to cycle the moving portion;

oscillating the diaphragm between the plurality of first positions and second positions below the mechanical resonance;

compressing the fluid to a desired second pressure and evacuating the fluid from said compression chamber at the second pressure.

32. A method for compressing a fluid according to claim 31, said fluid introducing step further comprising introducing a fluid into the compression chamber that is selected from the group of a refrigerant, a liquid or a gas.

33. A method for compressing a fluid according to claim 31, wherein said oscillating step further comprises oscillating the flexible portion of the diaphragm to at least two of the plurality of first portions on successive compression strokes, each of the at least two of the plurality of first positions being a varying distance from the wall of the compression chamber and oscillating the flexible portion of the diaphragm to at least two of the plurality of second positions on successive suction strokes, each of the at least two of the plurality of second positions being a varying distance from the wall of the compression chamber to provide a change in flow rate of the fluid during successive cycles.

34. A method for compressing a fluid according to 31, wherein said providing step further comprises providing the diaphragm having a first face within an interior of the compression chamber and a second face outside of the interior of the compression chamber, and a hole having a geometry sized and selected to communicate a sufficient quantity of fluid through the hole for equalizing pressure on the first and second faces; and further comprising after the oscillating step, equalizing pressure on the first and second faces of the diaphragm during said oscillating step by flowing fluid through the hole in response to varying pressure conditions in the compression chamber.

35. A method of compressing a fluid according to claim 31, further comprising the step of tuning the discharge port and suction port by selecting the geometry including the diameter, length and cross-sectional shape of the discharge port and the suction port to coordinate the timing of the filling and discharge of the fluid flow through the suction port and the discharge port and the pressure cycle in the compression chamber to provide a net flow in one direction of the fluid through the discharge port and suction port; and the compressing step further comprising flowing the fluid in a net flow in one direction.

36. A method of compressing a fluid according to claim 35, the pump providing step further comprising providing a tuned suction valve operatively connected to the suction port and a tuned discharge valve operatively connected to the discharge port, the suction valve and the discharge valve each having a predetermined stiffness and a valve duty cycle wherein the suction valve prevents flow of the fluid through the suction port in a closed position and allows flow through the suction port in an open position, and the discharge valve prevents flow of the fluid through the discharge port in a closed position and allows flow through the discharge port in an open position, and tuning the suction valve and discharge valve comprises selecting each valve stiffness and geometry to provide a duty cycle with a timing that is coordinated with the timing of the filling and discharge of the fluid flow through the suction port and the discharge port and the pressure cycle in the compression chamber to provide a net flow in one direction of the fluid within the pump; and the compressing step further comprises operating the suction valve and discharge valve with duty cycles that are coordinated in opening and closing with the timing of the filling of the fluid flow through the suction port and the discharging of the fluid flow through the discharge port and the pressure cycle in the compression chamber to provide a net flow in one direction of the fluid within the pump.

37. A method for compressing a fluid according to claim 31, wherein said operating step further comprising varying the drive frequency of the motor to oscillate the diaphragm at a frequency that is less than the mechanical resonance frequency.

38. A method of compressing a fluid according to claim 31, wherein said providing step further comprises providing a mechanical spring further comprising a leaf spring connected with the moving portion and said determining step further comprises determine the mass of the mechanical spring including the leaf spring and further comprising displacing and restoring the moving portion during the compression stroke.

39. A method of compressing a fluid according to claim 31, wherein said operating step and said oscillating step take place on successive strokes in a plurality of gravitational orientations.

40. A pump for compressing a fluid comprising:

a pump head comprising, a compression chamber including a wall having a geometry defining a partial enclosure with an opening and a flexible diaphragm rigidly connected at an outer perimeter of the opening of the wall, the diaphragm having a flexible portion capable of moving with respect to the outer perimeter between a plurality of first positions and a plurality of second positions, the wall and the diaphragm in the first and second positions defining first and second volumes of said compression chamber;

a suction port connected in communication with the compression chamber for flowing the fluid into the compression chamber;

a discharge port connected in communication with the compression chamber for flowing the fluid out of the compression chamber;

a fluid spring comprising the fluid within said compression chamber subject to varying pressure and flow conditions;

a mechanical spring comprising said diaphragm;

a motor comprising a moving portion having a diameter and cyclable between a plurality of first positions and second positions, the movement of the moving portion between one of the plurality of first positions and the successive of one of the plurality of second positions defining a stroke length, and the moving portion operably connected with the diaphragm for oscillating the diaphragm at a drive frequency for compressing the fluid; the ratio of the stroke length to the diaphragm diameter defining a stroke ratio, a combined moving mass of said moving portion and said diaphragm, and said mechanical spring and said fluid spring defining a mass-spring resonance frequency greater than or equal to the drive frequency.

41. A pump according to claim 40 wherein the motor is operable with the stroke lengths up to 0.10 inches for corresponding diameters of the moving portion of between about 1.5 inches and 4.75 inches and wherein the pump is operable with stroke ratios between about 0.07 and 0.002.

42. A pump according to claim 41 wherein the pump discharges fluid at a pressure of 30 to 80 psi.

43. A pump according to claim 40 wherein the pump is operable at frequencies at or greater than 100 cycles per second to produce desired fluid compression.

44. A pump according to claim 40, wherein said motor is a variable reluctance motor.

45. A pump according to claim 40, wherein the fluid is selected from the group consisting of a gas, a refrigerant or a liquid.

46. A pump according to claim 40, wherein said diaphragm further includes a first face within the compression chamber and a second face outside of an interior of the compression chamber and a hole between the first face and second face, the hole having a geometry sized and selected to communicate a sufficient quantity of fluid through said hole for equalizing pressure on the first and second faces of said diaphragm.

47. A pump according to claim 40, said suction port and said discharge port each having a geometry comprising diameter, length and cross-sectional shape, the geometry of each of the suction portion and the discharge port being selected to coordinate the filling and discharge of the fluid flow through the suction port and discharge port respectively in coordination with the pressure cycle in the compression chamber to provide a net flow in one direction of the fluid within the pump.

48. A pump according to claim 47, wherein the pump head further comprises a suction valve operatively connected to the suction port and a discharge valve operatively connected to the discharge port, said suction valve and said discharge valve each having a predetermined stiffness and a valve duty cycle, wherein the suction valve prevents fluid flow through the suction port in a closed position and allows flow through the suction port in an open position and the discharge valve prevents fluid flow through the discharge port in a closed position and allows flow through the discharge portion in an open position, and wherein the valve stiffness and geometry and size of the discharge valve and the suction valve each being selected to tune the suction valve and discharge valve to provide the timing of the duty cycles of the suction valve and the discharge valve in coordination with the timing of the filling of fluid flow through the suction port and the discharge of the fluid flow through the discharge port and the pressure cycle in the compression chamber to provide a net flow in one direction of the fluid within the pump.

49. A pump according to claim 40, further comprising control means operatively connected with the motor for varying the drive frequency to oscillate the diaphragm at a frequency that is less than the mechanical resonance frequency.

50. A high frequency pump for compressing a fluid comprising:

a compression chamber;

a fluid suction port and a fluid discharge port, each of the suction port and discharge port having a respective geometry including diameter, length and cross-section and each of the suction port and discharge port being in fluidic communication with the compression chamber for converting the cyclic fluid compressions into a flow of compressed fluid, the each of the suction port and the discharge port being tuned by selecting the port geometry to coordinate the timing of the filling and discharge of the fluid flow through the suction port and the discharge port and the pressure cycle in the compression chamber to provide a net flow in one direction of the fluid within the pump; a mechanical spring comprising a diaphragm connected with the compression chamber;

a fluid spring comprising the fluid within said compression chamber subject to varying pressure and flow conditions;

a motor having a moving portion operatively connected with the diaphragm for oscillating the diaphragm at a drive frequency for compressing the fluid;

a combined moving mass of said moving portion and said diaphragm, an said mechanical spring and said fluid spring defining a mass-spring resonance frequency greater than or equal to the drive frequency.

51. A pump according to claim 50, wherein the pump head further comprises a suction valve operatively connected to the suction port and a discharge valve operatively connected to the discharge port, said suction valve and said discharge valve each having a predetermined stiffness and a valve duty cycle, wherein the suction valve prevents fluid flow through the suction port in a closed position and allows flow through the suction port in an open position and the discharge valve prevents fluid flow through the discharge port in a closed position and allows flow through the discharge portion in an open position, and wherein the valve stiffness and geometry of the discharge valve and the suction valve are each selected to tune the suction valve and discharge valve to provide the timing of the duty cycles of the suction valve and the discharge valve in coordination with the timing of the filling of fluid flow through the suction port and the discharge of the fluid flow through the discharge port and the pressure cycle in the compression chamber to provide a net flow in one direction of the fluid within the pump.

52. A pump according to claim 51, wherein each of the suction valve and the discharge valve are adapted to be maintained in their open position by fluid pressure differential across the respective valve during flow and absent any mechanical stops.

53. A pump according to claim 52, wherein said valves are adapted to open and close through each of the valve duty cycles in a continuous motion.

54. A pump according to claim 50, wherein said pump further comprises:

a mechanical spring comprising a diaphragm connected with the compression chamber;

a fluid spring comprising the fluid within said compression chamber subject to varying pressure and flow conditions;

a motor having a moving portion operatively connected with the diaphragm for oscillating the diaphragm at a drive frequency for compressing the fluid;

wherein a mass-spring mechanical resonance frequency is determined by the combined moving masses of said moving portion and said diaphragm and by said mechanical spring and said gas spring and wherein the motor is operable at a drive frequency that is less than the frequency of said mechanical resonance.

55. A pump according to claim 50, wherein said diaphragm further includes a first face within the compression chamber and a second face outside of an interior of the compression chamber, and said pump further comprises an exterior chamber in fluid communication with the second ace of the diaphragm, and the pump further comprises a hole between said compression chamber and said exterior chamber, said hole having a geometry sized and selected to communicate a sufficient quantity of fluid through said hole between said compression chamber and said exterior chamber for equalizing pressure on the first and second faces of said diaphragm.

56. A pump according to claim 55, wherein said hole is positioned in said diaphragm.

57. A pump according to claim 55, wherein said diaphragm further comprises a plurality of holes, the number and geometry of said holes being selected to communicate a sufficient quantity of fluid between the compression chamber through the hole for equalizing pressure on the first and second faces of said diaphragm.

58. A pump according to claim 50, wherein the mechanical spring further comprises a leaf spring connected with the moving portion for providing restoring force an displacement of the moving portion during cycling of the moving portion to reduce pressure on the diaphragm.

59. A pump according to claim 50, further comprising control means operatively connected with the motor for varying the drive frequency to oscillate the diaphragm at a frequency that is less than the mechanical resonance frequency.

* * * * *